US008272611B2

(12) United States Patent
Schmidt et al.

(10) Patent No.: US 8,272,611 B2
(45) Date of Patent: Sep. 25, 2012

(54) BRACKET WITH LOCKING MECHANISM FOR FLUID DISPENSER

(75) Inventors: Laurie Schmidt, Dallas, TX (US); John Wiseman, Lewisville, TX (US)

(73) Assignee: Sports Solutions, Inc., Dallas, TX (US)

( * ) Notice: Subject to any disclaimer, the term of this patent is extended or adjusted under 35 U.S.C. 154(b) by 508 days.

(21) Appl. No.: 12/610,343

(22) Filed: Nov. 1, 2009

(65) Prior Publication Data

US 2011/0101196 A1 May 5, 2011

(51) Int. Cl.
*A47K 1/08* (2006.01)

(52) U.S. Cl. ..... 248/312; 248/312.1; 248/310; 211/77

(58) Field of Classification Search ..... 248/309.1, 248/310, 311.2, 312, 312.1, 102, 103, 105, 248/106; 211/74, 77; 224/414, 148.4, 148.1; 42/90, 106; 220/480
See application file for complete search history.

(56) References Cited

U.S. PATENT DOCUMENTS 3,229,858 A 1/1966 Lesh
4,213,592 A * 7/1980 Lingenfelser ..... 248/313
5,014,956 A * 5/1991 Kayali ..... 248/311.2
D328,216 S 7/1992 Steed
D336,196 S 6/1993 Gilchrist, Jr.
D385,287 S 10/1997 Westcott
5,975,470 A * 11/1999 Casey ..... 248/146
6,345,723 B1 2/2002 Blake et al.
6,527,240 B1 * 3/2003 Huang ..... 248/311.2
6,684,815 B1 * 2/2004 Rakoczy ..... 119/72
D501,781 S 2/2005 Galli
D533,742 S 12/2006 Matthews et al.
D547,988 S 8/2007 Baker et al.
D551,852 S 10/2007 Oas
D569,669 S 5/2008 Nichols et al.
D620,735 S 8/2010 Schmidt et al.
2012/0025047 A1 * 2/2012 Wilson et al. ..... 248/312
* cited by examiner

*Primary Examiner* — Terrell McKinnon
*Assistant Examiner* — Steven Marsh
(74) *Attorney, Agent, or Firm* — Howison & Arnott, L.L.P.

(57) ABSTRACT

An embodiment of a locking bottle holder includes a bottle support having a base portion, a body portion, and a top portion; and a collar plate having a collar portion with at least one dispenser opening, and a support portion with a first limit pin hole. The locking bottle holder further includes a first limit pin having a limit pin notch and a first limit pin shaft passing through the first limit pin hole, a first ring affixed to the support portion, and a floating lock pin passing through the first ring. The floating lock pin includes a lock pin shaft having a lock pin notch and rotatable between unlocked and locked positions. In the locked position, the support portion of the collar plate is positioned proximate to the body portion and the lock pin shaft is substantially engaged with the limit pin notch.

18 Claims, 32 Drawing Sheets

BRACKET WITH LOCKING MECHANISM FOR FLUID DISPENSER

TECHNICAL FIELD

Embodiments of the invention relate to bottle holders for secure mounting and holding of dispensing containers for dispensing fluids.

BACKGROUND

In fitness centers, health spas, and other facilities it is often desirable for the management of the facility to provide dispensing containers for dispensing liquids, such as lotions, soap, or shampoo, to the users of the facilities. However, the management may also desire to prevent unauthorized tampering with the dispensing containers or to prevent theft of the dispensing containers.

SUMMARY

An embodiment of a locking bottle holder includes a bottle support having a base portion, a body portion; and a top portion. The locking bottle holder further includes a collar plate including a collar portion having at least one dispenser opening therethrough, and a support portion having a first limit pin hole. The locking bottle holder further includes a first limit pin having a first limit pin shaft with a first end affixed to the body portion of the bottle support and a first limit pin notch proximate to the first end. The first limit pin shaft passes through the first limit pin hole of the support portion of the collar plate to facilitate sliding of the first limit pin hole of the collar plate along a portion of the first limit pin shaft of the first limit pin. The locking bottle holder further includes a first ring affixed to the support portion of the collar plate and proximate to a first side of the first limit pin hole of the collar plate. The locking bottle holder further includes a floating lock pin passing through the first ring. The floating lock pin includes a lock pin shaft having a lock pin notch. The floating lock pin is rotatable between an unlocked position and a locked position. In the locked position, the support portion of the collar plate is positioned proximate to the body portion of the bottle support and the lock pin shaft of the floating lock pin is substantially engaged with the limit pin notch of the first limit pin.

Another embodiment of a locking bottle holder includes a bottle support having a base portion, a body portion, and a top portion. The top portion has an arcuate-shaped edge along a portion thereof. The locking bottle holder further includes a collar plate having a collar portion having a dispenser opening therethrough, and a support portion having a first limit pin hole and a second limit pin hole therethrough. The locking bottle holder further includes a first limit pin including a first limit pin shaft having a first end affixed to the body portion of the bottle support and a first limit pin notch proximate to the first end. The first limit pin shaft passes through the first limit pin hole of the support portion of the collar plate to facilitate sliding of the first limit pin hole of the collar plate along a portion of the first limit pin shaft of the first limit pin. The locking bottle holder further includes a second limit pin including a second limit pin shaft having a first end affixed to the body portion of the bottle support. The second limit pin shaft passing through the second limit pin hole of the collar plate to facilitate sliding of the second limit pin hole of the collar plate along a portion of the second limit pin shaft of the second limit pin. The locking bottle holder further includes a first ring affixed to the support portion of the collar plate and proximate to a first side of the first limit pin hole of the collar plate, and a second ring affixed to the support portion of the collar plate and proximate to a second side of the first limit pin hole of the collar plate. The locking bottle holder still further includes a floating lock pin passing through the first ring and the second ring. The floating lock pin includes a lock pin shaft having a lock pin notch. The floating lock pin is rotatable between an unlocked position and a locked position. In the unlocked position, the support portion of the collar plate is positioned away from the body portion of the bottle support and the lock pin notch of the floating lock pin is substantially engaged with the first limit pin shaft of the first limit pin. In the locked position, the support portion of the collar plate is positioned proximate to the body portion of the bottle support and the lock pin shaft of the floating lock pin is substantially engaged with the limit pin notch of the first limit pin.

BRIEF DESCRIPTION OF THE DRAWINGS

For a more complete understanding, reference is now made to the following description taken in conjunction with the accompanying Drawings in which.

DETAILED DESCRIPTION

Figure 1A:
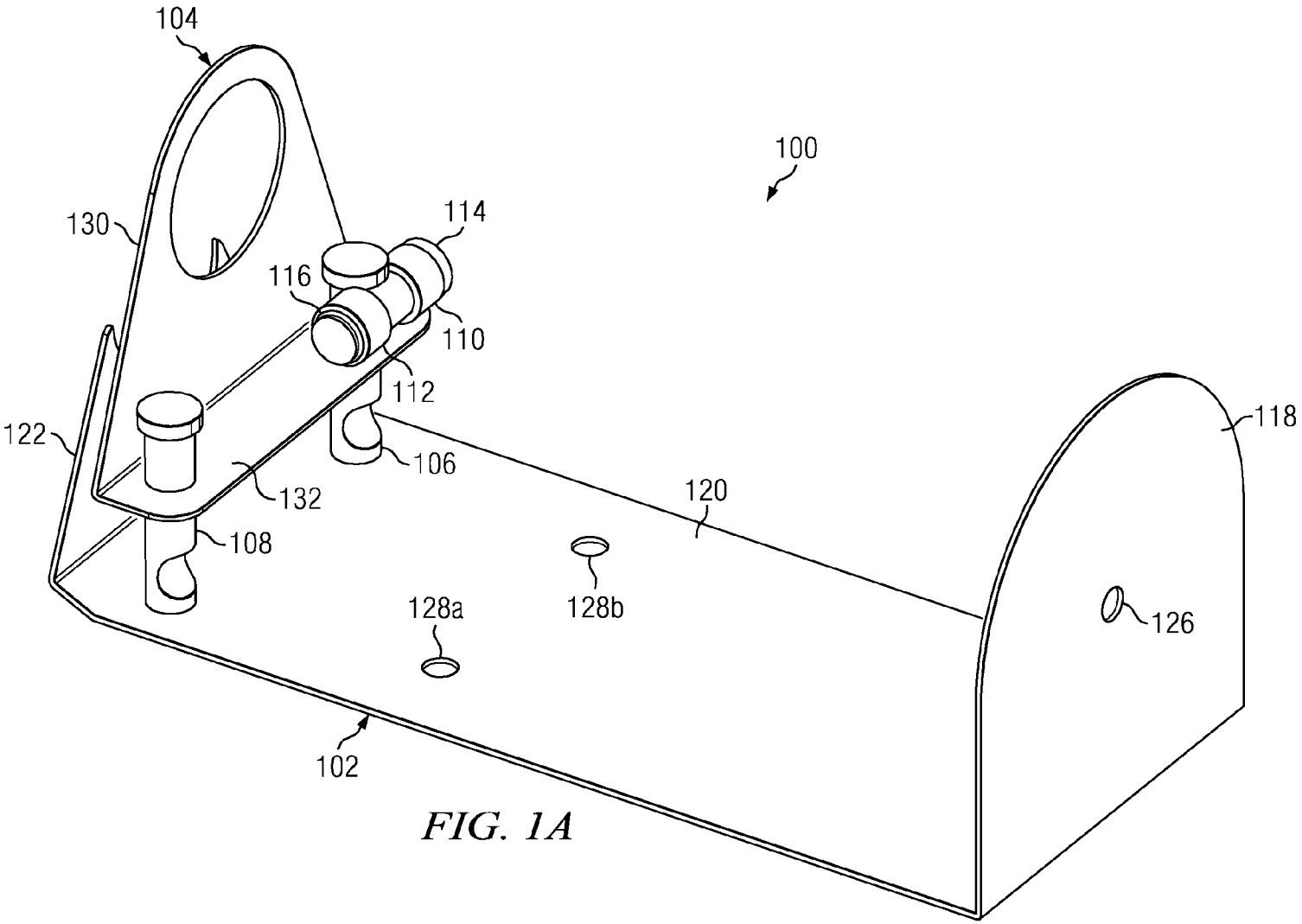
FIGS. 1A-1C illustrate an embodiment of a single locking bottle holder.

Referring now to the drawings, wherein like reference numbers are used herein to designate like elements throughout, the various views and embodiments of a bracket with locking mechanism for fluid dispenser are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 1B:
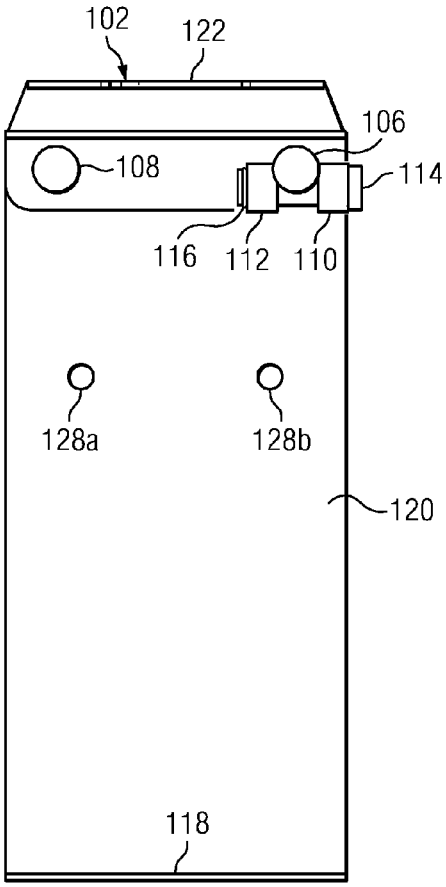
Figure 1C:
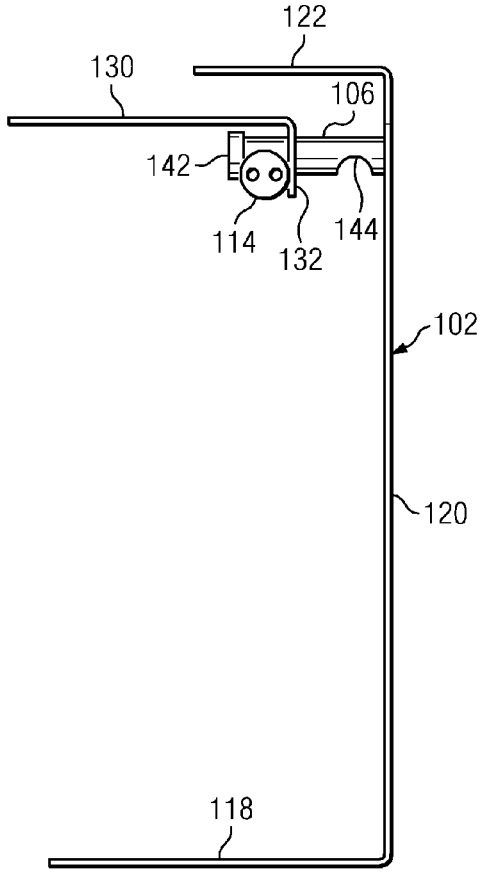

FIGS. 1A-1C illustrate an embodiment of a single locking bottle holder 100. The single locking bottle holder 100 includes a single bottle support 102, a single collar plate 104, a first limit pin 106, a second limit pin 108, a first ring 110, a second ring 112, a floating lock pin 114, and a snap ring 116. FIG. 1A illustrates a perspective view of the embodiment of the single locking bottle holder 100. FIG. 1B illustrates a front view of the embodiment of the single locking bottle holder 100. FIG. 1C illustrates a right-side view of embodiment of the single locking bottle holder 100. In at least one embodiment, the single bottle support 102 is configured to hold a dispensing container thereon. The first limit pin 106 and the second limit pin 108 are affixed to the single bottle support 102, and the single collar plate 104 is slidably coupled to the first limit pin 106 and the second limit pin 108 such that the single collar plate 104 may be positioned close or proximate to the single bottle support 102 in a locked state, or positioned in an extended position away from the single bottle support 102 in an unlocked state. In at least one embodiment, the first ring 110 and the second ring 112 are affixed to the single collar plate 104 near the first limit pin 106, and the floating lock pin 114 passes through and is rotatable within the first ring 110 and the second ring 112. In at least one embodiment, the snap ring 116 is configured to secure the floating lock pin 114 within the first ring 110 and the second ring 112. In various embodiments, the floating lock ping 114 is rotatable into a locked position in engagement with the first limit pin 106 in order to lock the single collar plate 104 in place proximate to the single bottle support 102. Various embodiments of the single locking bottle holder 100 provide for secure mounting and holding of a dispensing container to prevent unauthorized tampering with or theft of the dispensing container as will be further described with respect to the accompanying FIGS. 1A-15D.

Figure 2A:
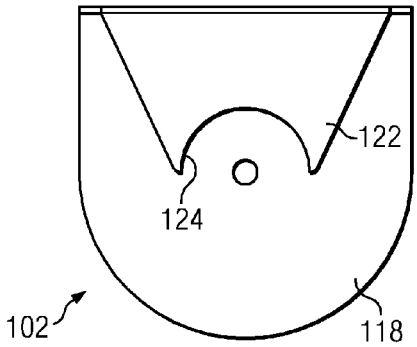
FIGS. 2A-2C illustrate an embodiment of the single bottle support of the single locking bottle holder of FIGS. 1A-1C.
Figure 2B:
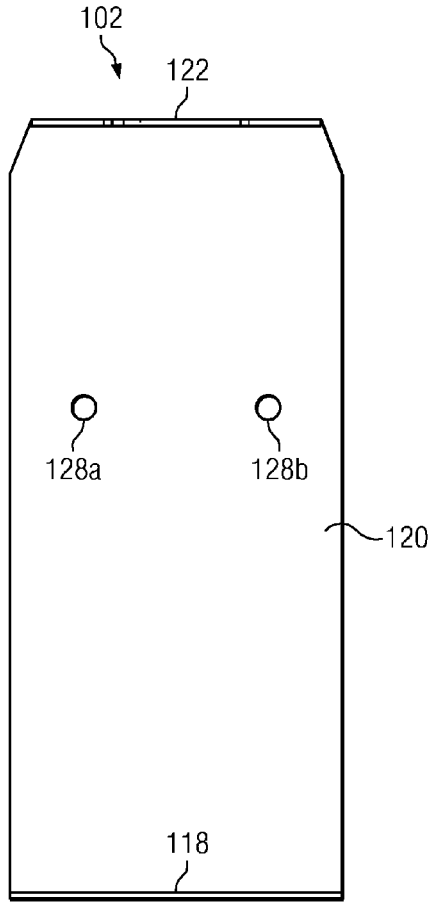
Figure 2C:
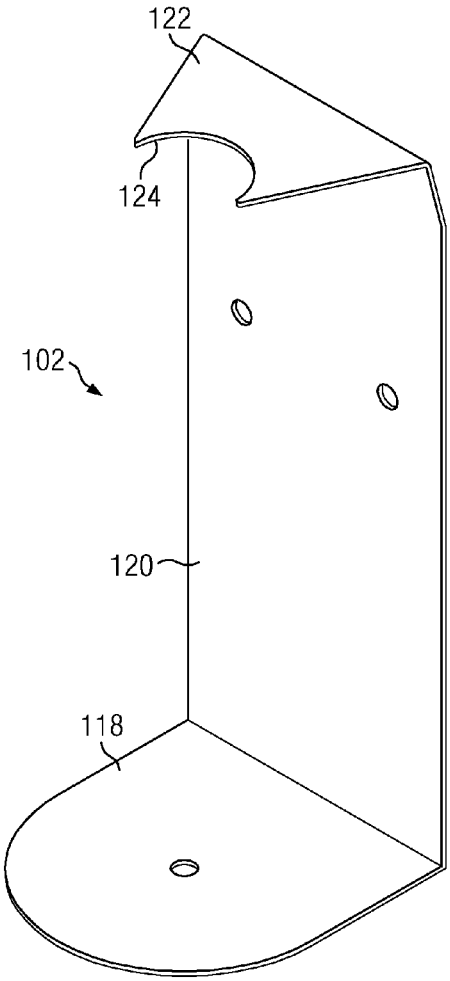

FIGS. 2A-2C illustrate an embodiment of the single bottle support 102 of the single locking bottle holder 100 of FIGS. 1A-1C. FIG. 2A illustrates a top view of the embodiment of the single bottle support 102. FIG. 2B illustrates a front view of the embodiment of the single bottle support 102. FIG. 2C illustrates a perspective view of the embodiment of the single bottle support 102. The single bottle support 102 includes a base portion 118, a body portion 120, and a top portion 122. In the particular embodiment of the single bottle support 102 illustrated in FIGS. 2A-2C, the base portion 118 and top portion 122 lie in horizontal planes substantially parallel to each other, the body portion 120 lies in a vertical plane substantially perpendicular to the base portion 118 and the top portion 122. In at least one embodiment, the top portion 122 has an inward arcuate-shaped edge 124 along a portion to accommodate a top and/or dispenser portion of a container. In a particular embodiment, the inward arcuate-shaped edge 124 is formed in a substantially half-circular shape. In other embodiments, the top portion 122 may have any desired shape such as having an outwardly curved edge or a flat edge. In a particular embodiment, the base portion 118 includes a curved front portion. In at least one embodiment, the base portion 118 includes a substantially flat surface for resting a dispensing container thereon. In a particular embodiment, the base portion 118 includes a base mounting hole 126, which may be used to mount the single bottle support 102 to a horizontal surface, and the body portion 120 includes one or more body mounting holes 128*a*, 128*b*, which may be used to mount the single bottle support 102 to a vertical surface. In other embodiments, the base portion 118 may include one or more body mounting holes 126 or, alternately, no body mounting holes 126. In other embodiments, the body portion 120 may include one or more body mounting holes 128*a*, 128*b*, or, alternately, no body mounting holes 128*a*, 128*b*. In at least one embodiment, the single bottle support 102 is formed of a single piece of material, such as metal, that is bent to form the base portion 118, the body portion 120 and the top portion 122.

Figure 3A:
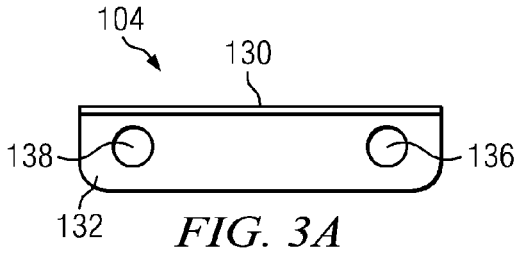
FIGS. 3A-3C illustrate an embodiment of the single collar plate of the single locking bottle holder of FIGS. 1A-1C.
Figure 3B:
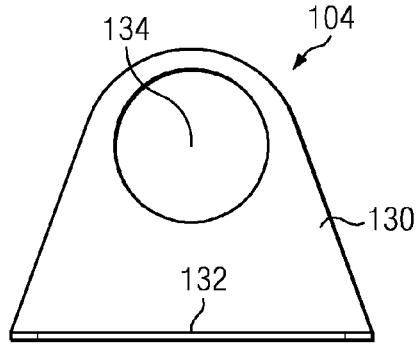
Figure 3C:
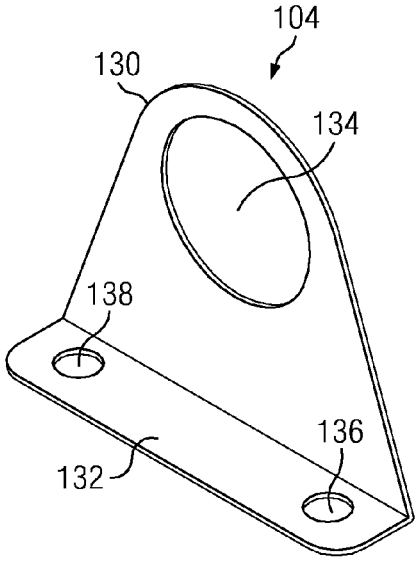

FIGS. 3A-3C illustrate an embodiment of the single collar plate 104 of the single locking bottle holder 100 of FIGS. 1A-1C. FIG. 3A illustrates a front view of the embodiment of the single collar plate 104. FIG. 3B illustrates a bottom view of the embodiment of the single collar plate 104. FIG. 3C illustrates a perspective view of the embodiment of the single collar plate 104. The single collar plate 104 includes a collar portion 130 and a support portion 132. In at least one embodiment, the collar portion 130 is of a shape having an outwardly curved edge. In various embodiments, the collar portion 130 includes a dispenser opening 134 therethrough to allow a portion of a dispensing container such as a top and/or dispenser portion of the dispensing container to pass through and be retained by the dispenser opening 134. In at least one embodiment, the dispenser opening 134 is substantially circular in shape. In the illustrated embodiment, the support portion 132 includes a first limit pin hole 136 and a second limit pin hole 138. In at least one embodiment, the collar portion 130 and the support portion 132 lie in planes substantially perpendicular to each other. In at least one embodiment, the single collar plate 104 is formed of a single piece of material, such as metal, that is bent to form the collar portion 130 and the support portion 132.

Figure 4A:
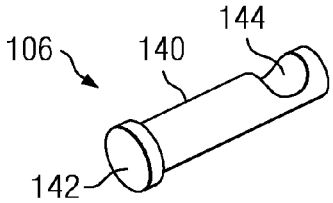
FIGS. 4A-4D illustrate an embodiment of the first limit pin of the single locking bottle holder of FIGS. 1A-1C.
Figure 4B:
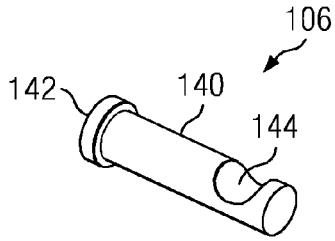
Figure 4C:
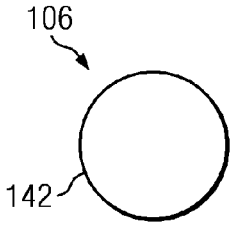
Figure 4D:
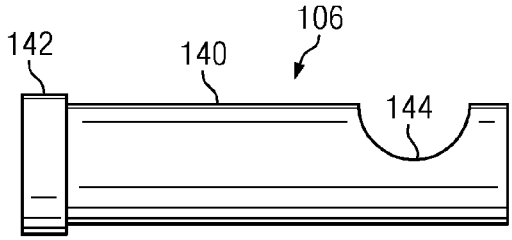

FIGS. 4A-4D illustrate an embodiment of the first limit pin 106 of the single locking bottle holder 100 of FIGS. 1A-1C. FIG. 4A illustrates a front perspective view of the embodiment of the first limit pin 106. FIG. 4B illustrates a rear perspective view of the embodiment of the first limit pin 106. FIG. 4C illustrates a front view of the embodiment of the first limit pin 106. FIG. 4D illustrates a side view of the embodiment of the first limit pin 106. The first limit pin 106 includes a first limit pin shaft 140 and a first limit pin head 142 at a first end of the first limit pin shaft 140. In at least one embodiment, the first limit pin shaft 140 is of a substantially cylindrical shape. In a particular embodiment, the first limit pin head 142 has a cross-sectional diameter greater than a cross-sectional diameter of the first limit pin shaft 140, and further having a cross-sectional diameter greater than a cross-sectional diameter of the first limit pin hole 136. The first limit pin 106 further includes a first limit pin notch 144 at a location proximate to a second end of the first limit pin shaft 140. In a particular embodiment, the first limit pin notch 144 is formed in or cut out of the first limit pin shaft 140 and has a concave arcuate cross-section.

Figure 8:
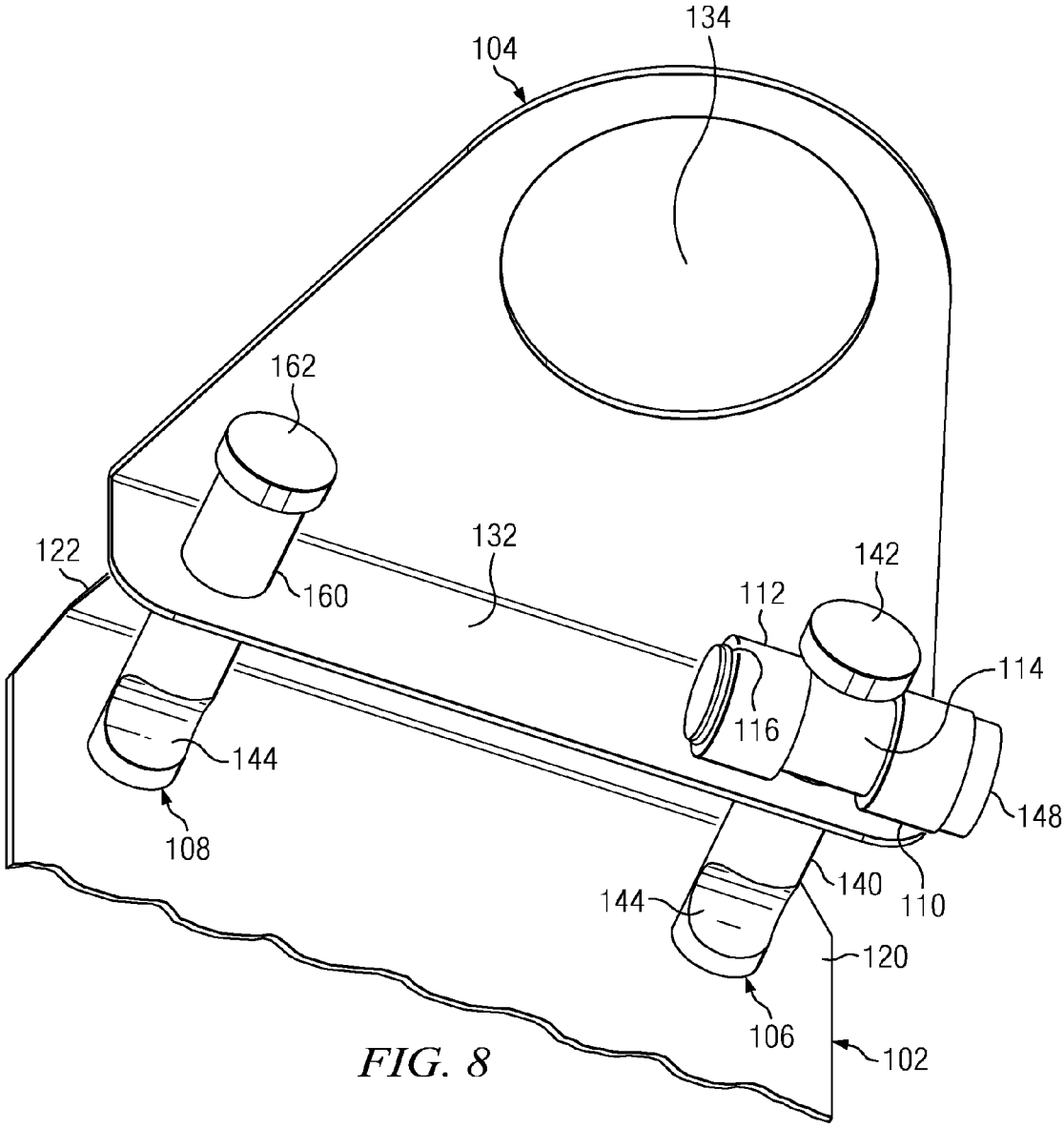
FIG. 8 illustrates a perspective view of an upper portion of the single locking bottle holder of FIGS. 1A-1C.

In at least one embodiment, the second limit pin 108 is constructed in substantially the same manner as the first limit pin 106 including a second limit pin shaft 160, a second limit pin head 162, and a limit pin notch 144 to allow for a single component design to be used for both the first limit pin 106 and the second limit pin 108 (see FIG. 8). In still other embodiments, the first limit pin notch 144 may be omitted from the second limit pin 108.

Figure 5A:
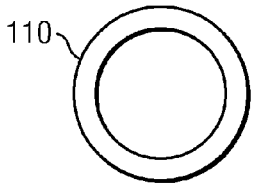
FIGS. 5A-5C illustrates an embodiment of the first ring of the single locking bottle holder of FIGS. 1A-1C.
Figure 5B:
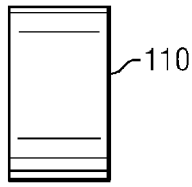
Figure 5C:
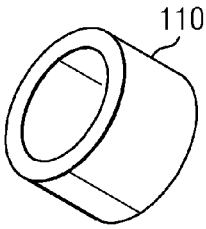

FIGS. 5A-5C illustrates an embodiment of the first ring 110 of the single locking bottle holder 100 of FIGS. 1A-1C. FIG. 5A illustrates a side view of the embodiment of the first ring 110 of the single locking bottle holder 100 of FIGS. 1A-1C. FIG. 5B illustrates a front view of the embodiment of the first ring 110 of the single locking bottle holder 100 of FIGS. 1A-1C. FIG. 5C illustrates a perspective view of the embodiment of the first ring 110 of the single locking bottle holder 100 of FIGS. 1A-1C. In at least one embodiment, the first ring 110 is of a hollow, substantially cylindrical shape having a substantially circular cross section. Although not illustrated in FIGS. 5A-5C, it should be understood that the second ring 112 may be formed in a substantially similar manner to the first ring 110.

Figure 6A:
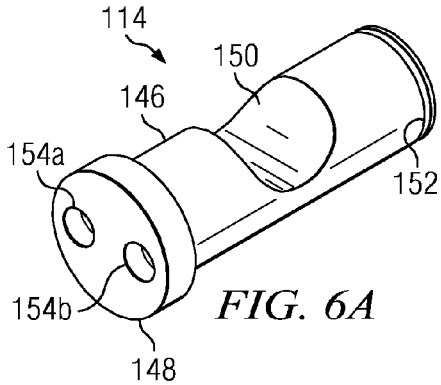
FIGS. 6A-6E illustrate an embodiment of the floating lock pin of the single locking bottle holder of FIGS. 1A-1C.
Figure 6B:
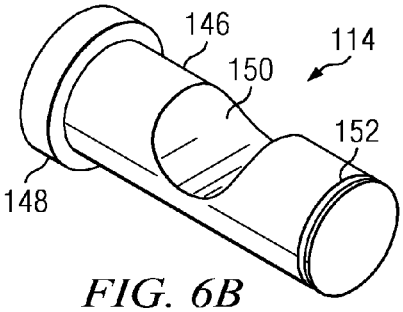
Figure 6C:
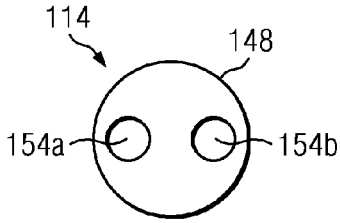
Figure 6D:
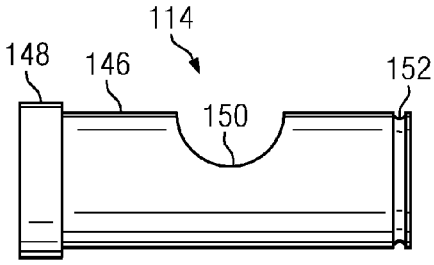
Figure 6E:
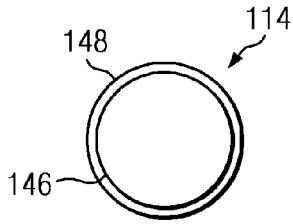

FIGS. 6A-6E illustrate an embodiment of the floating lock pin 114 of the single locking bottle holder 100 of FIGS. 1A-1C. FIG. 6A illustrates a front perspective view of the embodiment of the floating lock pin 114 of the single locking bottle holder 100 of FIGS. 1A-1C. FIG. 6B illustrates a rear perspective view of the embodiment of the floating lock pin 114 of the single locking bottle holder 100 of FIGS. 1A-1C. FIG. 6C illustrates a front view of the embodiment of the floating lock pin 114 of the single locking bottle holder 100 of FIGS. 1A-1C. FIG. 6D illustrates a side view of the embodiment of the floating lock pin 114 of the single locking bottle holder 100 of FIGS. 1A-1C. FIG. 6E illustrates a rear view of the embodiment of the floating lock pin 114 of the single locking bottle holder 100 of FIGS. 1A-1C. The floating lock pin 114 includes a lock pin shaft 146 and a lock pin head 148 at a first end of the lock pin shaft 146. In at least one embodiment, the lock pin shaft 146 is of a substantially cylindrical shape. In a particular embodiment, the lock pin head 148 has a cross-sectional diameter greater than a cross-sectional diameter of the lock pin shaft 146. The lock pin shaft 146 includes a lock pin notch 150 at a location along the lock pin shaft 146. In a particular embodiment, the lock pin notch 150 is positioned at a location substantially halfway between ends of the lock pin shaft 146. In a particular embodiment, the lock pin notch 150 is formed in or cut out of the lock pin shaft 146 and has a concave arcuate cross-section. In various embodiments, an inner surface of the lock pin notch 150 is configured to substantially engage a portion of the circumference of the first limit pin shaft 140. In various embodiments, an inner surface of the first limit pin notch 144 is configured to substantially engage a portion of the circumference of the lock pin shaft 146. Although the illustrated embodiments are shown as using the first ring 110 and the second ring 112, in other embodiments a single ring having a cut-out portion to allow engagement of the floating lock pin 114 with the first limit pin 106 may be used.

The lock pin shaft 146 further includes a snap ring groove 152 at a second end of the lock pin shaft 146. In at least one embodiment, the snap ring groove 152 is formed along the entire circumference of the lock pin shaft 146 at the second end of the lock pin shaft 146. The snap ring groove 152 is formed to accommodate placement of the snap ring 116 within the snap ring groove 152. In a particular embodiment, the lock pin head 148 further includes keyholes 154*a*, 154*b* disposed within a top surface of the lock pin head 148. The keyholes 154*a*, 154*b* are formed to allow the insertion of a key or other tool (not illustrated) to facilitate rotation of the floating lock pin 114 by a user inserting prongs of the key or tool into the keyholes 154*a*, 154*b* and applying a rotational motion. Although the embodiment of FIG. 6A is illustrated as having two keyholes 154*a*, 154*b* it should be understood that in other embodiments more than two keyholes may be used. In still other embodiments, the floating lock pin 114 may be constructed having no keyholes.

Figure 7:
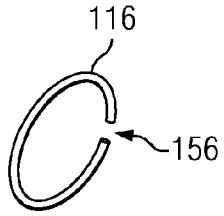
FIG. 7 illustrates a perspective view of an embodiment of the snap ring of the single locking bottle holder of FIGS. 1A-1C.

FIG. 7 illustrates a perspective view of an embodiment of the snap ring 116 of the single locking bottle holder 100 of FIGS. 1A-1C. In the particular embodiment illustrated in FIG. 7, the snap ring 116 is formed in a substantially circular-shape with an open end. The open end 156 allows the snap ring 116 to be placed in the snap ring groove 152 of the floating lock pin 114 and is held within the snap ring groove 152 by tension of the snap ring 116.

FIG. 8 illustrates a perspective view of an upper portion of the single locking bottle holder 100 of FIGS. 1A-1C. In the illustrated embodiment, the first limit pin shaft 140 of the first limit pin 106 and second limit pin 108 are passed through the first limit pin hole 136 and the second limit pin hole 138, respectively, of the support portion 132 of the single collar plate 104. The floating lock pin 114 is placed through the first ring 110 and the second ring 112 and secured by placing the snap ring 116 within the snap ring groove 152 of the floating lock pin 114. The first ring 110 is affixed to the support portion 132 of the single collar plate 104 proximate to a first side of the first limit pin hole 136. The second ring 112 is affixed to the support portion 132 of the single collar plate 104 proximate to a second side of the first limit pin hole 136 of the single collar plate 104.

The first limit pin shaft 140 of the first limit pin 106 and the second limit pin shaft 160 of the second limit pin 108 are each affixed to the body portion 120 of the single bottle support 102. In various embodiments, the end of the first limit pin shaft 140 opposite to the first limit pin head 142 and the end of the second limit pin shaft 160 opposite to the second limit pin head 162 are affixed to the body portion 120. In at least one embodiment, the first limit pin 106 and the second limit pin 108 are affixed to the body portion 120 proximate to the top portion 122 of the single bottle support 102. In one embodiment, the first limit pin 106 and the second limit pin 108 are affixed to the body portion 120 via welding. In another embodiment, the first limit pin 106 and the second limit pin 108 are affixed to the body portion via an adhesive. In still other embodiments, the first limit pin 106 and the second limit pin 108 are affixed to the body portion 120 using any other suitable fastener device or fastening method.

In the unlocked position, the support portion 132 of the collar plate 104 may be positioned away from the body portion 120 of the single bottle support 102 by orienting the lock pin notch 150 of the floating lock pin 114 such that it is substantially engaged with a portion of the circumference of the first limit pin shaft 140 of the first limit pin 106. In the unlocked position of the floating lock pin 114, the first limit pin shaft 140 passing through the first limit pin hole 136 of the support portion 132 of the single collar plate 104 facilitates sliding of the first limit pin hole 136 along a portion of the first limit pin shaft 140 of the first limit pin 106. In addition, the second limit pin hole 138 of the support portion 132 of the single collar plate 104 is allowed to slide along a portion of the second limit pin 108. Accordingly, the single collar plate 104 may be positioned away from the body portion 120 of the single bottle support 102 when the floating lock pin 114 is positioned in the unlocked position. In at least one embodiment, the first limit pin head 142 and the second limit pin head 162 have cross-sectional diameters greater than the cross-sectional diameters of the first limit pin hole 136 and the second limit pin hole 138, respectively, to prevent removal of the single collar plate 104 from the first limit pin 106 and the second limit pin 108.

In order to place the single collar plate 104 in the locked position, a user moves the single collar plate 104 proximate to the body portion 120 of the single bottle support 102 until the floating lock pin 114 is positioned at the first limit pin notch 144 of the first limit pin shaft 140. The user then rotates the floating lock pin 114 until the portion of the lock pin shaft 146 opposite the lock pin notch 150 is substantially engaged with the first limit pin notch 144 of the first limit pin 106. In at least one embodiment, the user rotates the floating lock pin 114 by engaging a key or tool in the keyholes 154*a*, 154*b* of the lock pin head 148 and applying a turning motion. In the locked position, the single collar plate 104 is prevented from substantial movement along the first limit pin shaft 140, thus preventing removal of a dispensing container placed within the single locking bottle holder 100.

Figure 9A:
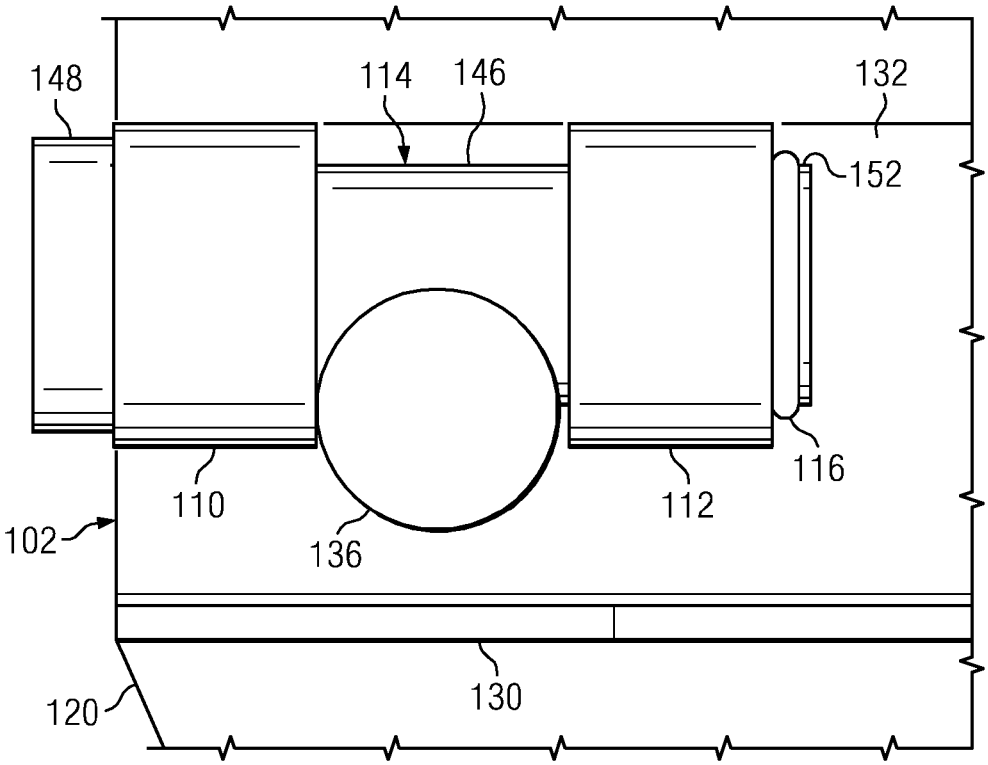
FIGS. 9A-9B illustrate a portion of the embodiment of the single locking bottle holder in which the first limit pin is not shown.
Figure 9B:
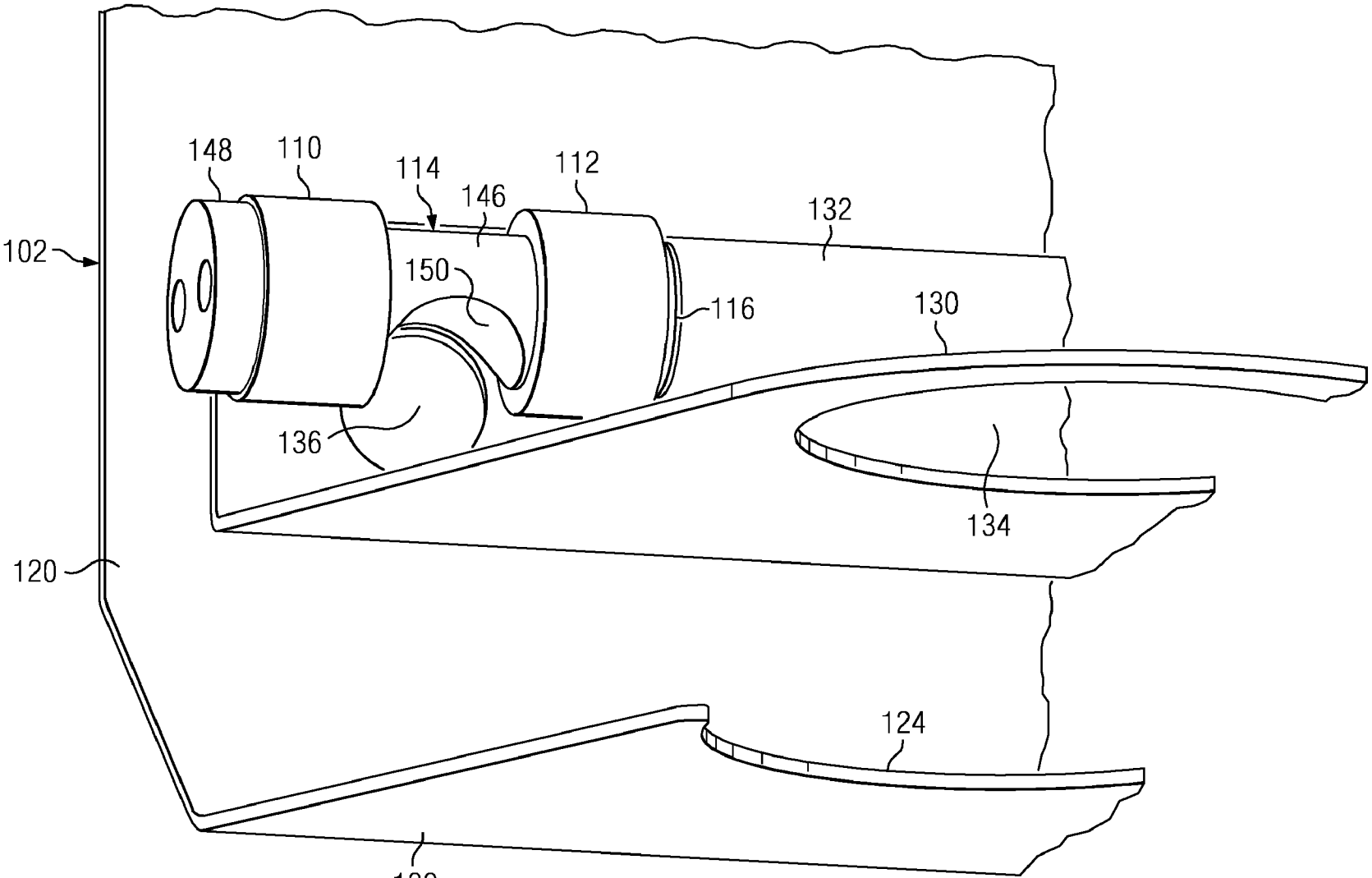

FIGS. 9A-9B illustrate a portion of the embodiment of the single locking bottle holder 100 in which the first limit pin 106 is not shown. FIG. 9A illustrates a top view of the portion of the embodiment of the single locking bottle holder 100 in which the first limit pin 106 is not shown. FIG. 9B illustrates a perspective top view of the portion of the single locking bottle holder 100 in which the first limit pin 106 is not shown. As illustrated in FIGS. 9A-9B, the lock pin notch 150 of the floating lock pin 114 is arranged such that a portion of the first limit pin shaft 140 may pass through the lock pin notch 150 when the floating lock pin 114 is in the unlocked position.

Figure 10A:
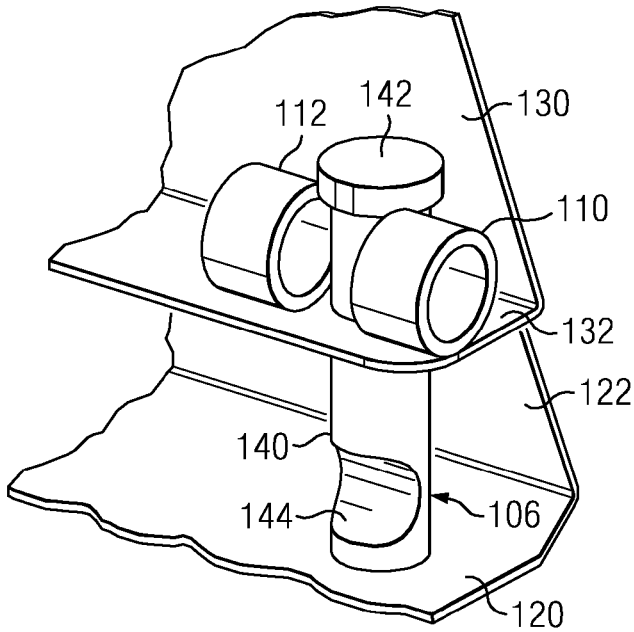
FIGS. 10A-10B illustrate a portion of the embodiment of the single locking bottle holder in which the floating lock pin is not shown.
Figure 10B:
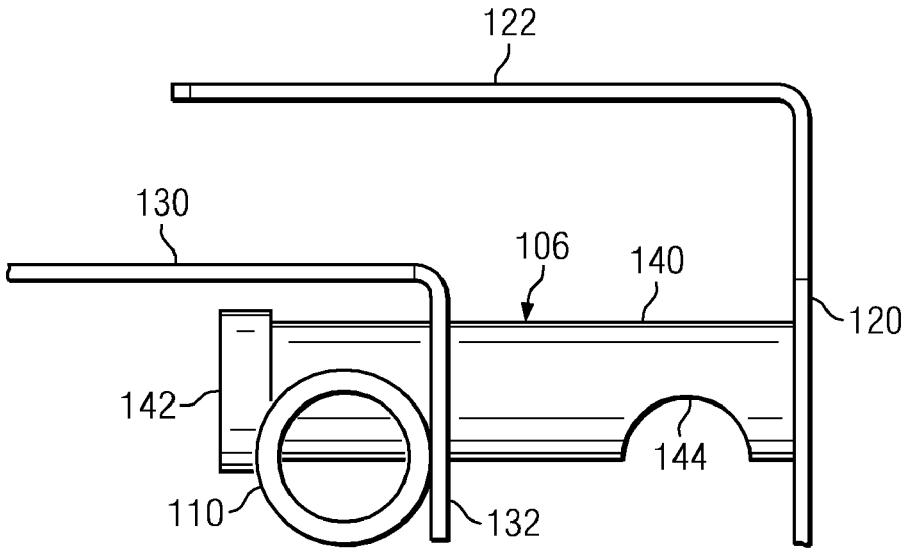

FIGS. 10A-10B illustrate a portion of the embodiment of the single locking bottle holder 100 in which the floating lock pin 114 is not shown. FIG. 10A illustrates a perspective view of the portion of the embodiment of the single locking bottle holder 100. FIG. 10B illustrates a side view of the portion of the embodiment of the single locking bottle holder 100.

Figure 11A:
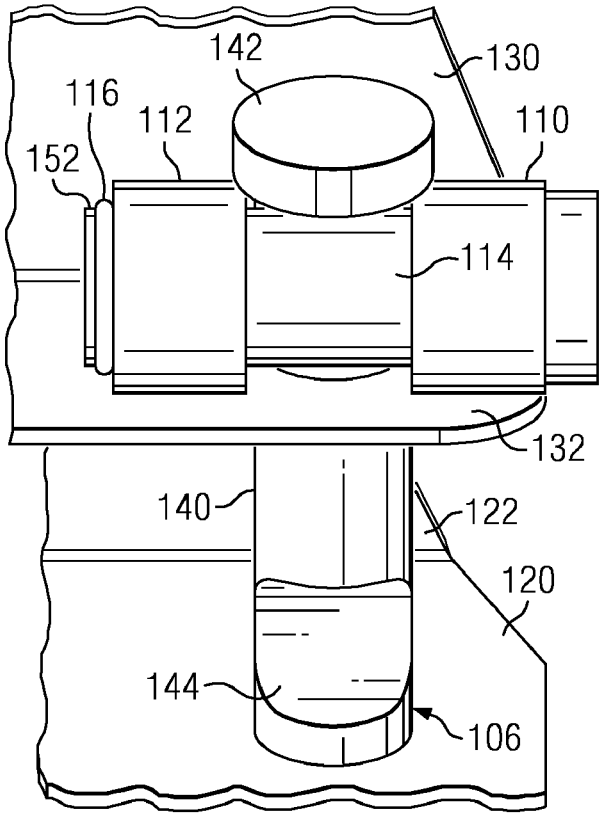
FIGS. 11A-11D illustrate a portion of the embodiment of the single locking bottle holder showing the floating lock pin in the unlocked position.
Figure 11B:
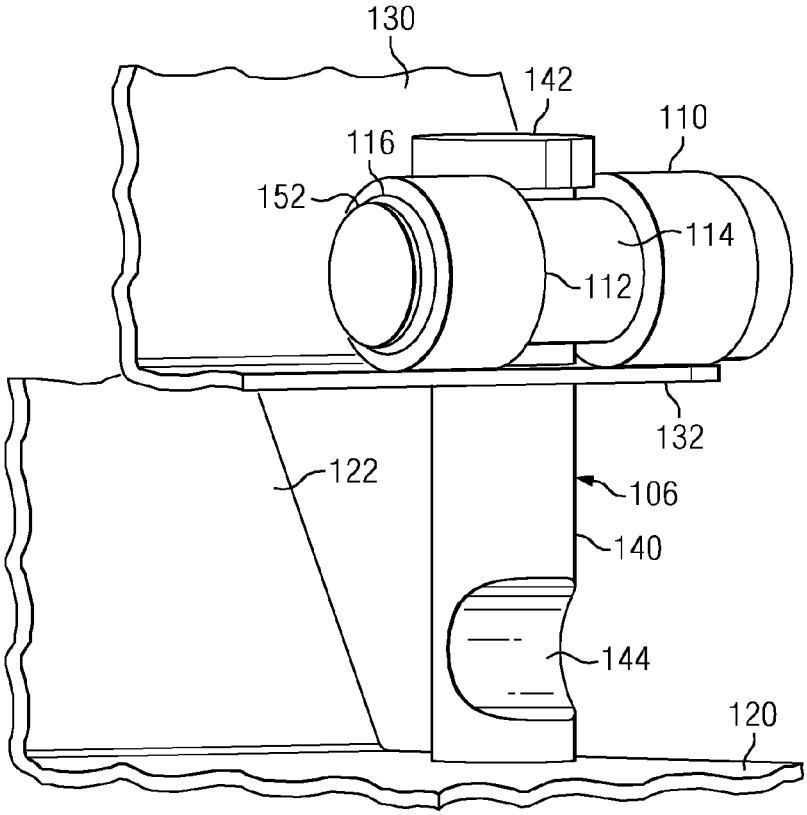
Figure 11D:
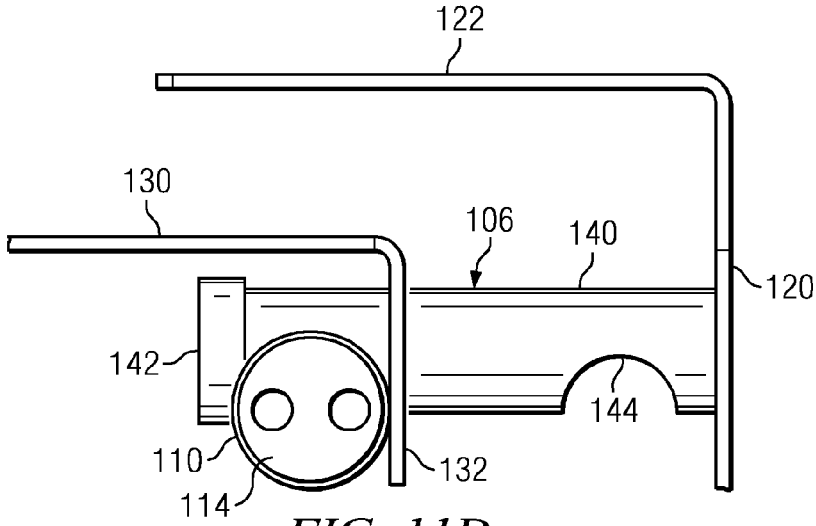
Figure 11C:
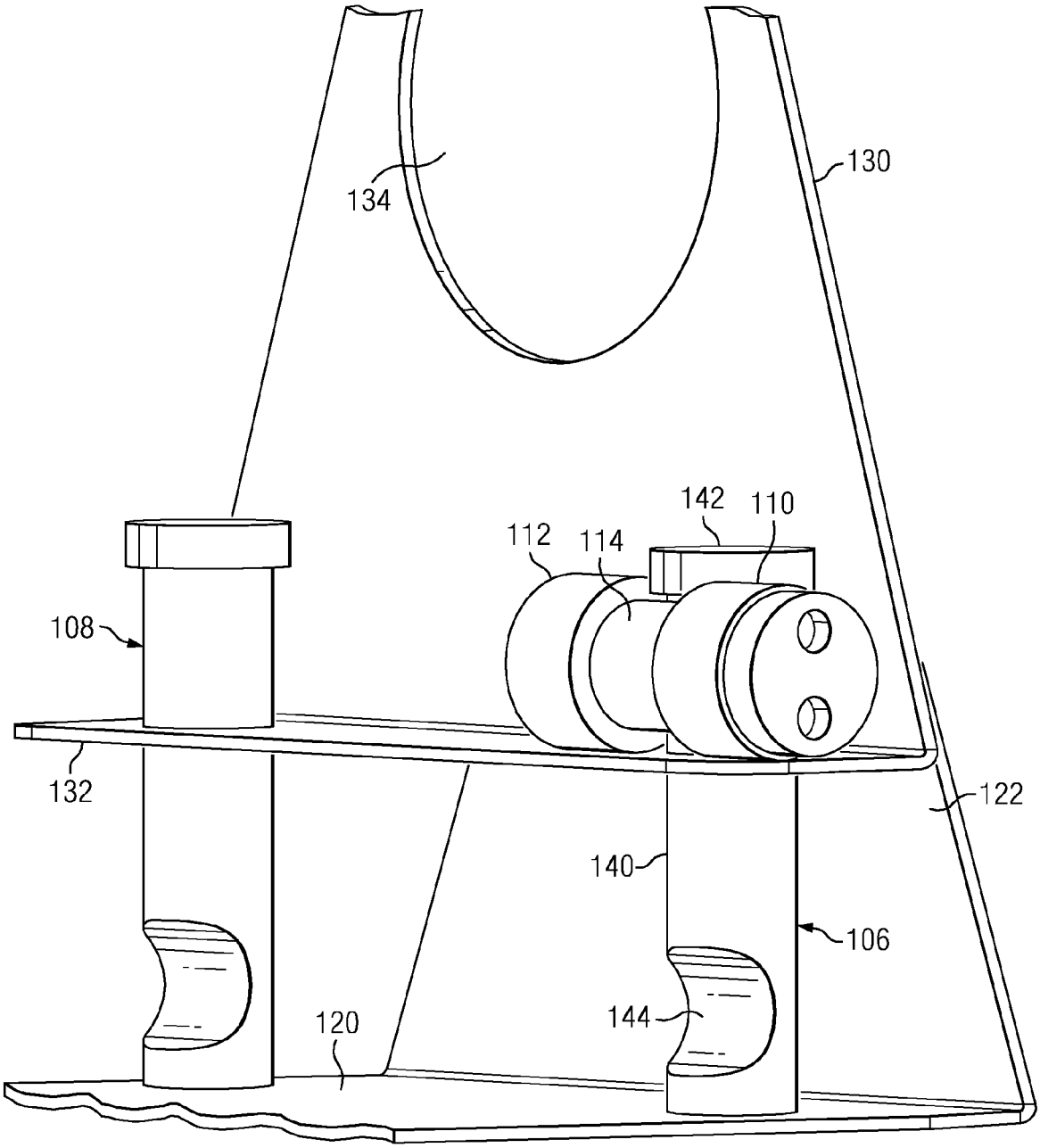

FIGS. 11A-11D illustrate a portion of the embodiment of the single locking bottle holder 100 showing the floating lock pin 114 in the unlocked position. FIG. 11A illustrates a front perspective view of the portion of the embodiment of the single locking bottle holder 100 showing the floating lock pin 114 in the unlocked position. FIG. 11B illustrates a left perspective view of the portion of the embodiment of the single locking bottle holder 100 showing the floating lock pin 114 in the unlocked position. FIG. 11C illustrates a right perspective view of the portion of the embodiment of the single locking bottle holder 100 showing the floating lock pin 114 in the unlocked position. FIG. 11D illustrates a right side view of the portion of the embodiment of the single locking bottle holder 100 showing the floating lock pin 114 in the unlocked position.

Figure 12:
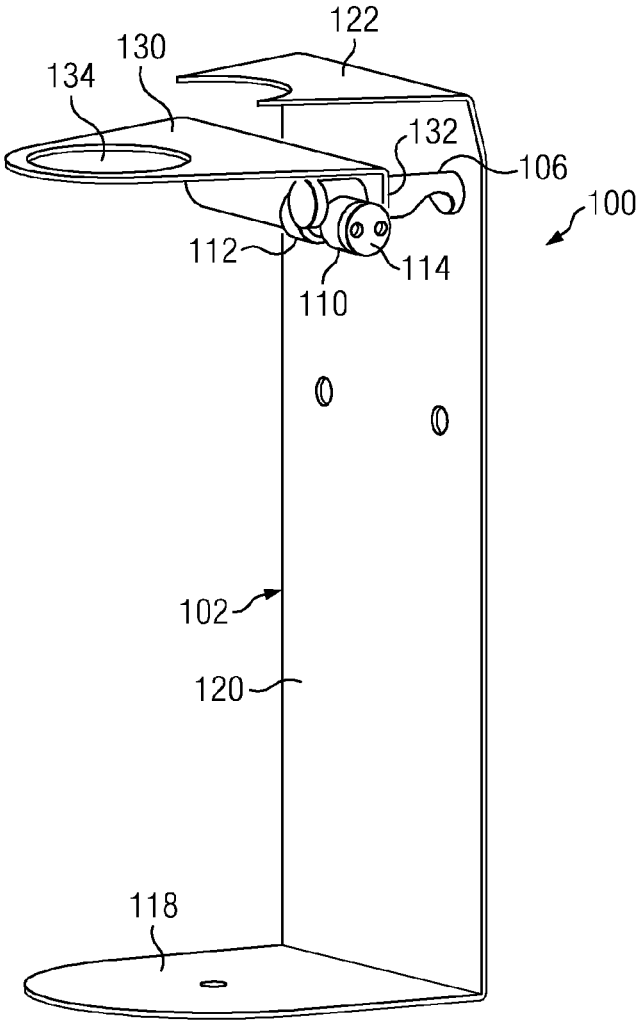
FIG. 12 illustrates an embodiment of the single locking bottle holder in which the floating lock pin is in an unlocked position.

FIG. 12 illustrates an embodiment of the single locking bottle holder 100 in which the floating lock pin 114 is in an unlocked position. As illustrated in FIG. 12, the single collar plate 104 is in an extended position and the floating lock pin 114 is in an unlocked state such that the single collar plate 104 is freely slidable along the first limit pin 106 and the second limit pin 108.

Figure 13:
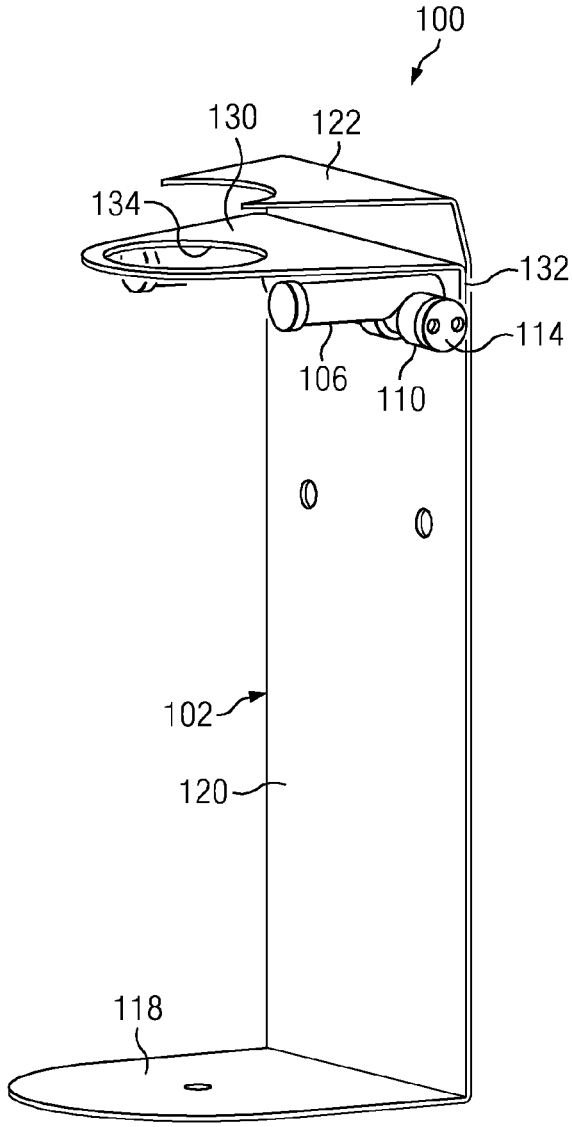
FIG. 13 illustrates an embodiment of the single locking bottle holder in which the floating lock pin is in a locked position.

FIG. 13 illustrates an embodiment of the single locking bottle holder 100 in which the floating lock pin 114 is in a locked position. As illustrated in FIG. 13, the single collar plate 104 is in a retracted position and the floating lock pin 114 is engaged with the first limit pin notch 144 of the first limit pin 106. While the floating lock pin 114 is in the locked position, the single collar plate 104 is prevented from sliding along the first limit pin 106 and the second limit pin 108.

Figure 14:
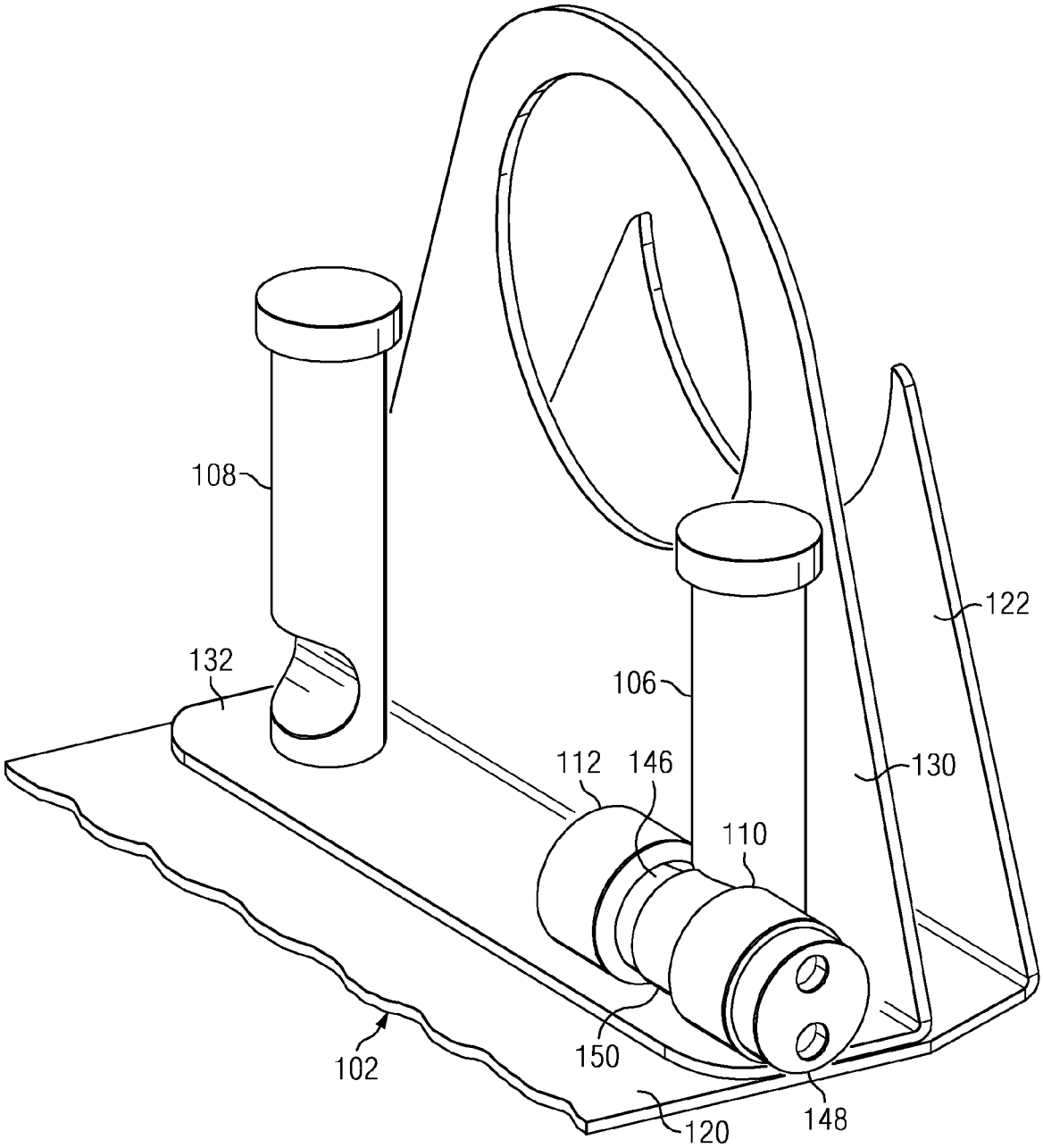
FIG. 14 illustrates a portion of the embodiment of the single locking bottle holder showing the floating lock pin in the locked position.

FIG. 14 illustrates a portion of the embodiment of the single locking bottle holder 100 showing the floating lock pin 114 in the locked position. In the embodiment illustrated in FIG. 14, the support portion 132 of the single collar plate 104 is disposed proximate to the body portion 120 of the single bottle support 102. In addition, the floating lock pin 114 has been rotated by substantially 180 degrees from the unlocked position such that a portion of the lock pin shaft 146 is engaged with the first limit pin notch 144 of the first limit pin 106. In the locked position, the single collar plate 104 is substantially prevented from being moved away from the body portion 120 of the single bottle support 102.

Figure 15A:
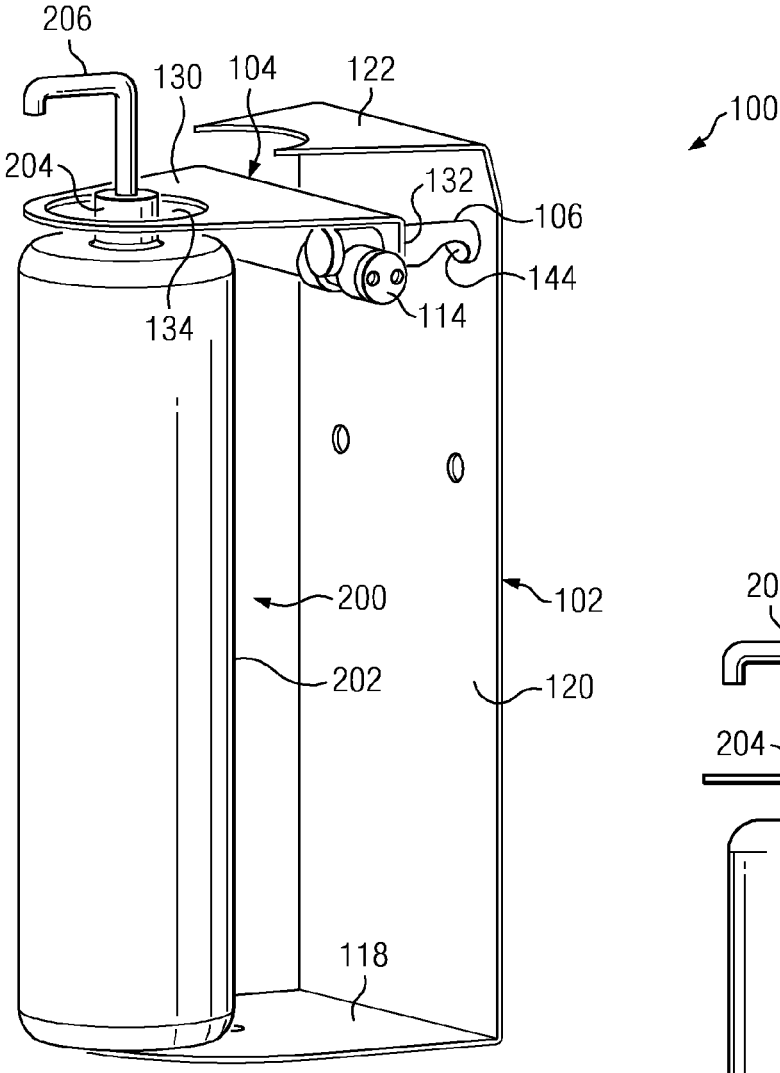
FIGS. 15A-15D illustrate the placement and securement of a dispensing container within the single locking bottle holder.
Figure 15B:
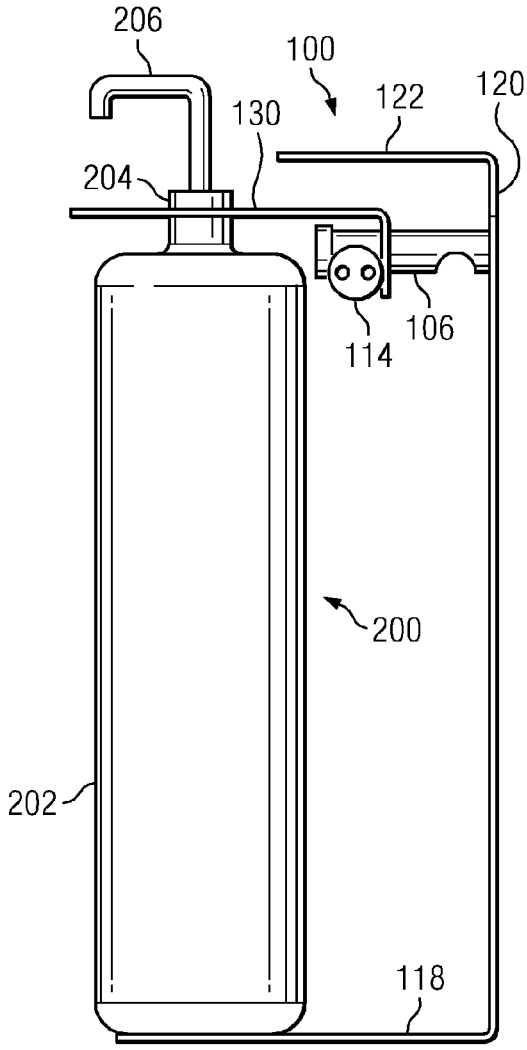

FIGS. 15A-15D illustrate the placement and securement of a dispensing container 200 within the single locking bottle holder 100. FIG. 15A illustrates a perspective view of the dispensing container 200 and the single locking bottle holder 100 in an unlocked state. FIG. 15B illustrates a side view of the dispensing container 200 and the single locking bottle holder 100 in an unlocked state. The dispensing container 200 includes a container body portion 202 and a container top portion 204. In at least one embodiment, the dispensing container 200 is configured to hold and dispense a desired fluid or other substance such as soap, shampoo or lotion. In various embodiments, the container body portion 202 is coupled to the container top portion 204. In one embodiment, the container top portion 204 is threadably coupled to the container body portion 202. In still other embodiments, the container top portion 204 may be integrally formed with the container body portion 202. In the particular embodiment illustrated in FIG. 15A-15B, the container top portion 204 includes a dispenser portion 206 configured to dispense a fluid contained within the container body portion 202. In a particular embodiment, the dispenser portion 206 may include a dispensing pump.

Still referring to FIGS. 15A-15B, in order to place the dispensing container 200 within the single locking bottle holder 100, a user tilts the lower portion of the container body portion 202 of dispensing container 200 away from the body portion 120 of the single bottle support 102; places the dispenser portion 206 through the dispenser opening 134 of the single collar plate 104; and rests the container body portion 202 upon the base portion 118 of the single bottle support 102. Upon resting of the container body portion 202 upon the base portion 118, one or more of the container top portion 204 and the dispenser portion 206 of the dispensing container 200 pass through the dispenser opening 134 of the single collar plate 104. The single collar plate 104 is then moved by the user into the locked position such that the single collar plate 104 is positioned proximate to the body portion 120 of the single bottle support 102. The floating lock pin 114 is then rotated by the user into the locked position such that a portion of the lock pin shaft 146 of the floating lock pin 114 is substantially engaged with the first limit pin notch 144 of the first limit pin 106. In various embodiments, a cross-sectional dimension, such as a diameter, of the dispenser opening is less than the largest cross-sectional dimension of the container body portion 202 of the dispensing container 200. As a result, the container body portion 202 cannot be lifted through the dispenser opening 134.

Figure 15C:
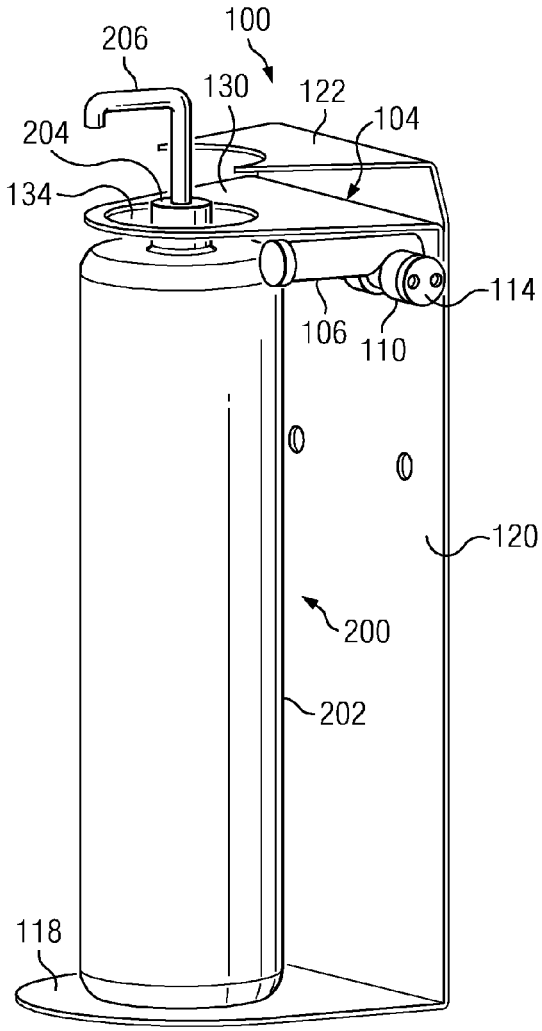
Figure 15D:
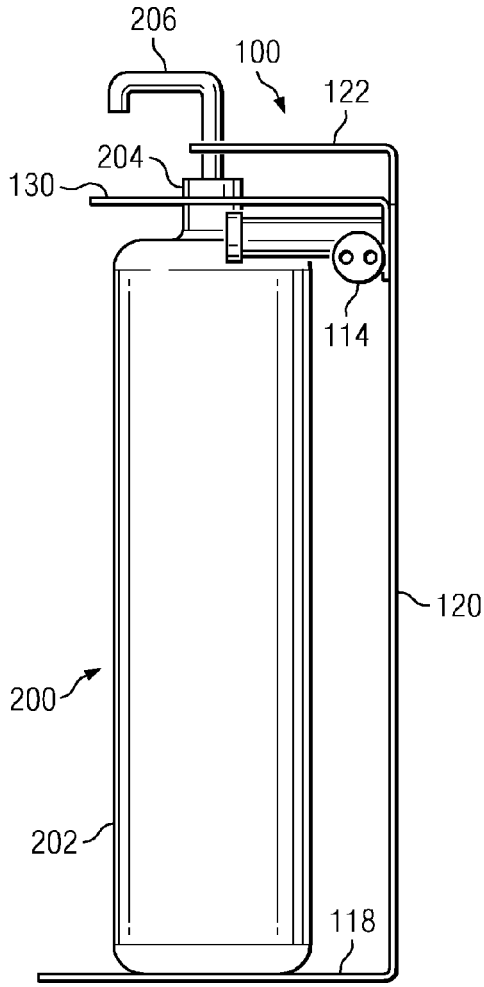

FIG. 15C illustrates a perspective view of the dispensing container 200 secured within the single locking bottle holder 100 in a locked state. FIG. 15D illustrates a side view of the dispensing container 200 secured within the single locking bottle holder 100 in the locked state. As illustrated in FIGS. 15C-15D, the dispensing container 200 is secured within the single locking bottle holder 100 such that the container body portion 202 cannot be lifted through the dispenser opening 134. In addition, the arcuate-shaped edge 124 of the top portion 122 of the single bottle support 102 is disposed adjacent to one or more of the container top 204 and the dispenser portion 206 of the dispensing container 200. Due to the resting of the container body portion 202 upon the base portion 118 of the single bottle support 102, and the proximity of the arcuate-shaped edge 124 of the top portion 122 of the single bottle support 102 to one or more of the container top 204 and the dispenser portion 206, removal of the dispensing container 200 from the single bottle locking bottle holder 100 is prevented when in the locked position. As a result, a consumer may dispense the substance contained within the container body portion 202 using the dispenser portion 206, while unauthorized removal or access to the dispensing container 200 is prevented.

Figure 16A:
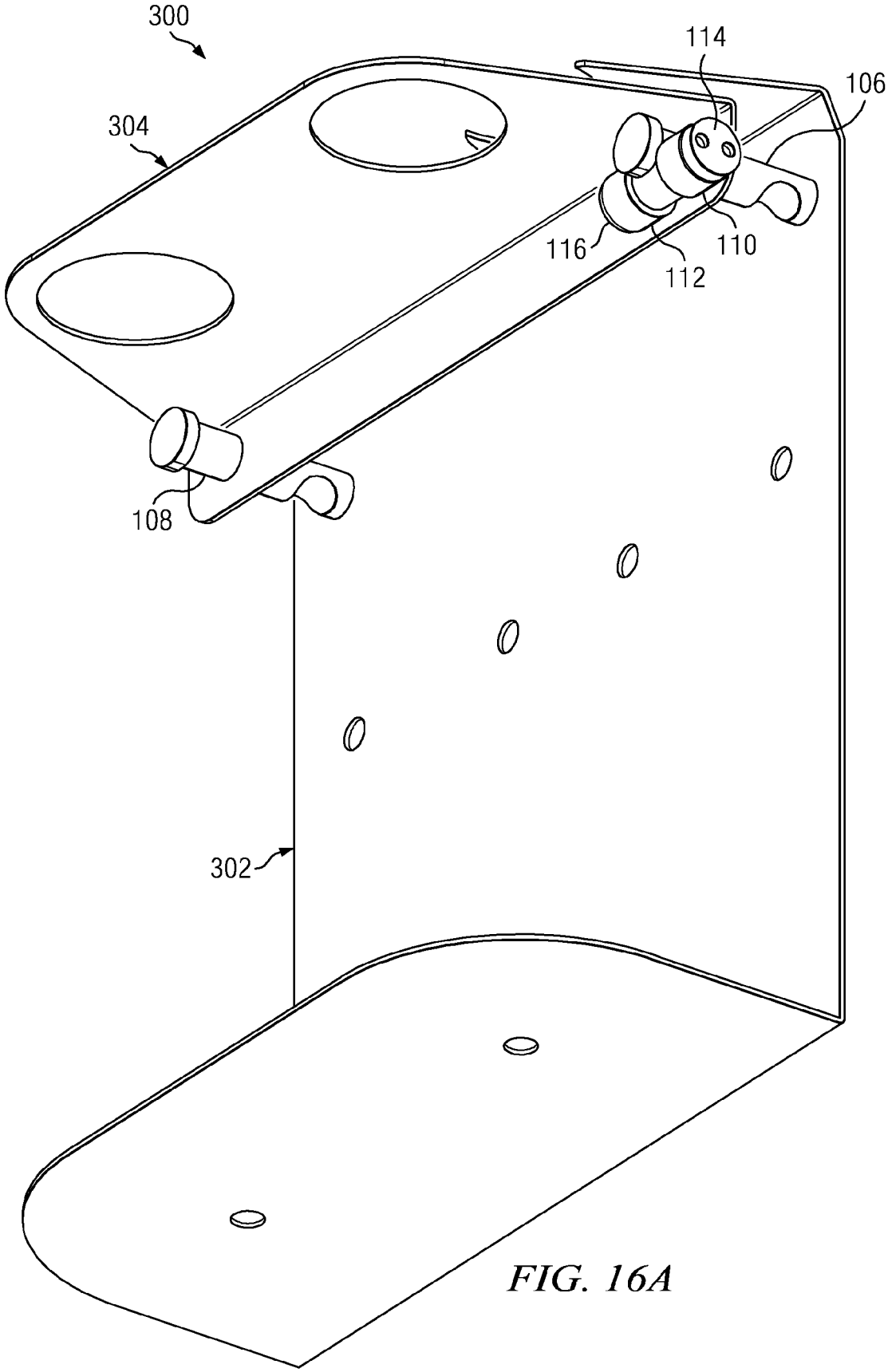
FIGS. 16A-16B illustrate an embodiment of a double locking bottle holder configured to securely mount and hold up to two dispensing containers.
Figure 16B:
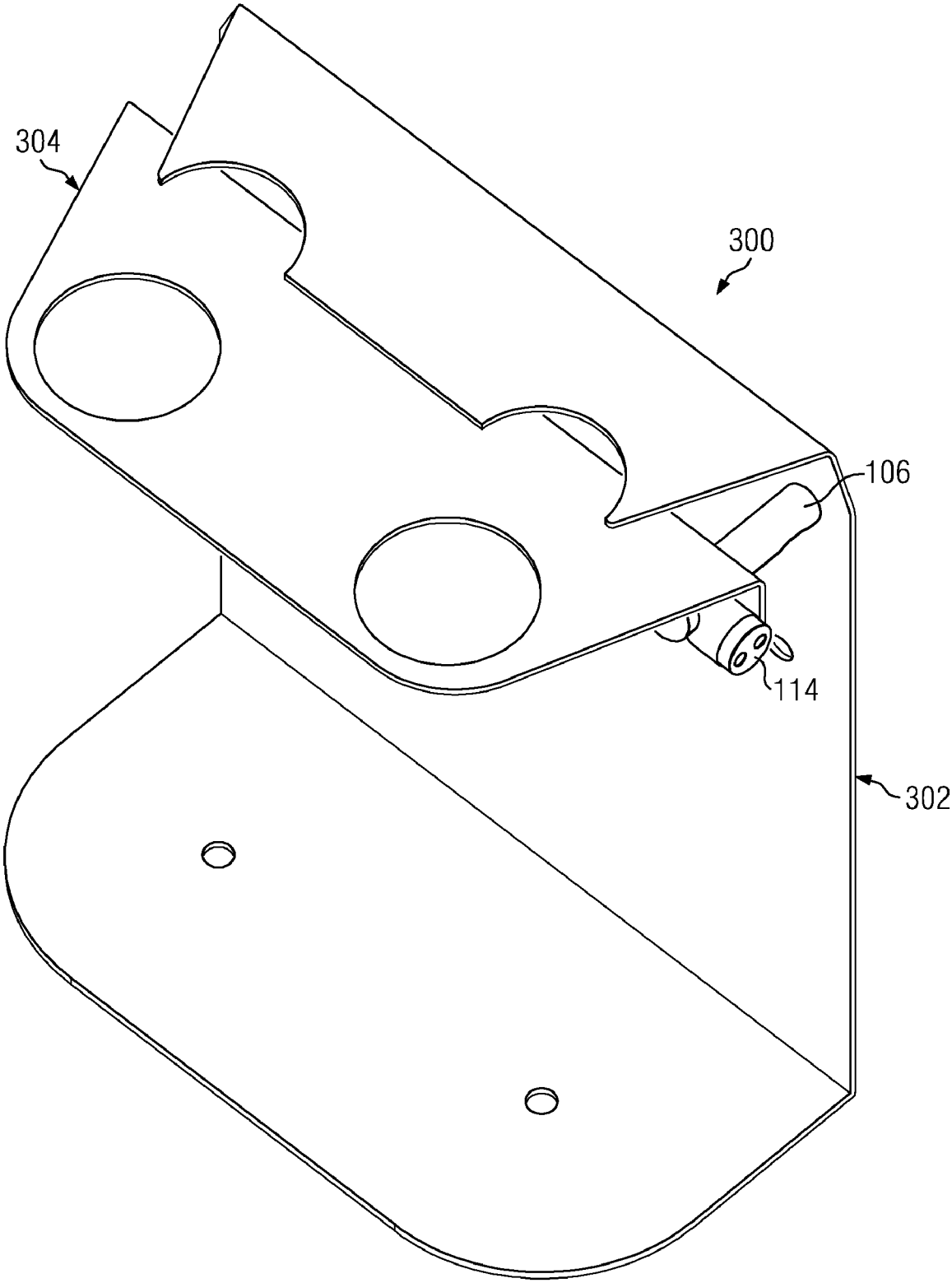

FIGS. 16A-16B illustrate an embodiment of a double locking bottle holder 300 configured to securely mount and hold up to two dispensing containers. The double locking bottle holder 300 includes a double bottle support 302, a double collar plate 304, the first limit pin 106, the second limit pin 108, the first ring 110, the second ring 112, the floating lock pin 114, and the snap ring 116. FIG. 16A illustrates a right-side perspective view of the embodiment of the double locking bottle holder 300. FIG. 16B illustrates a top perspective view of the embodiment of the double locking bottle holder 300. The double locking bottle holder 300 is configured to operate in a similar manner as the single locking bottle holder 100 previously described herein except that the double locking bottle holder 300 provides for the capability to securely mount and hold up to two dispensing containers.

Figure 17A:
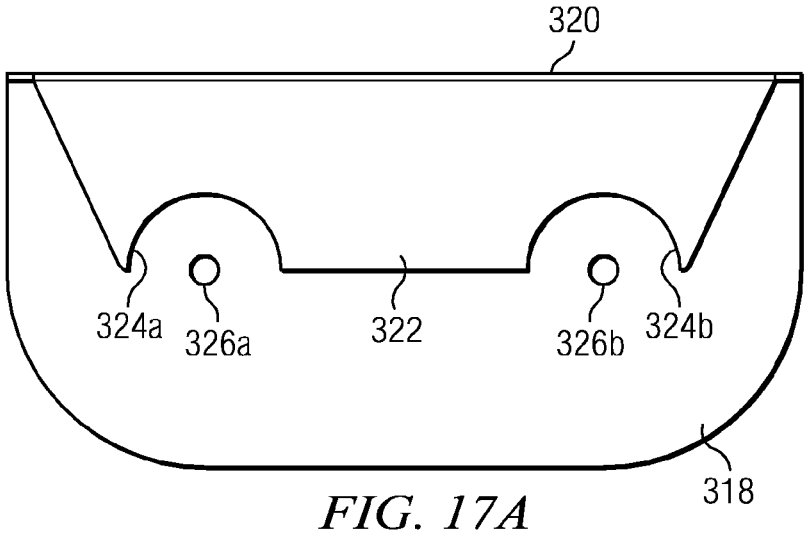
FIGS. 17A-17D illustrate an embodiment of the double bottle support of FIGS. 16A-16B.
Figure 17B:
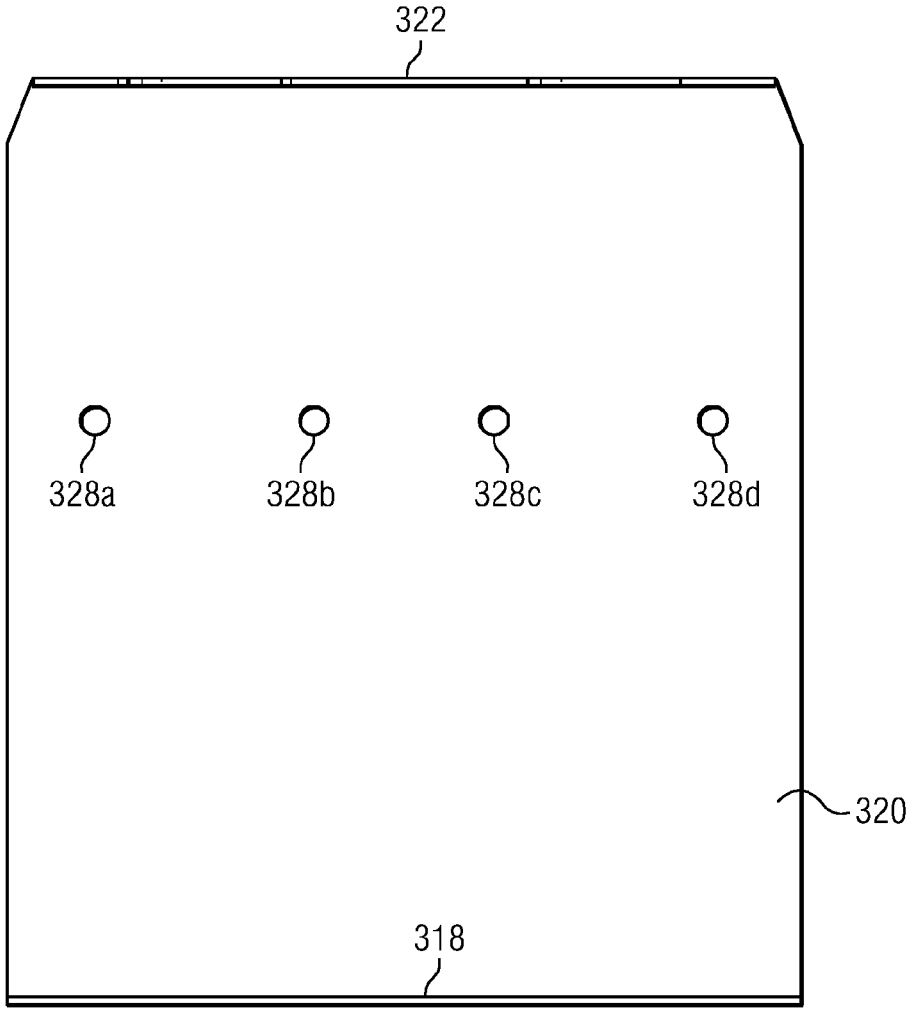
Figure 17C:
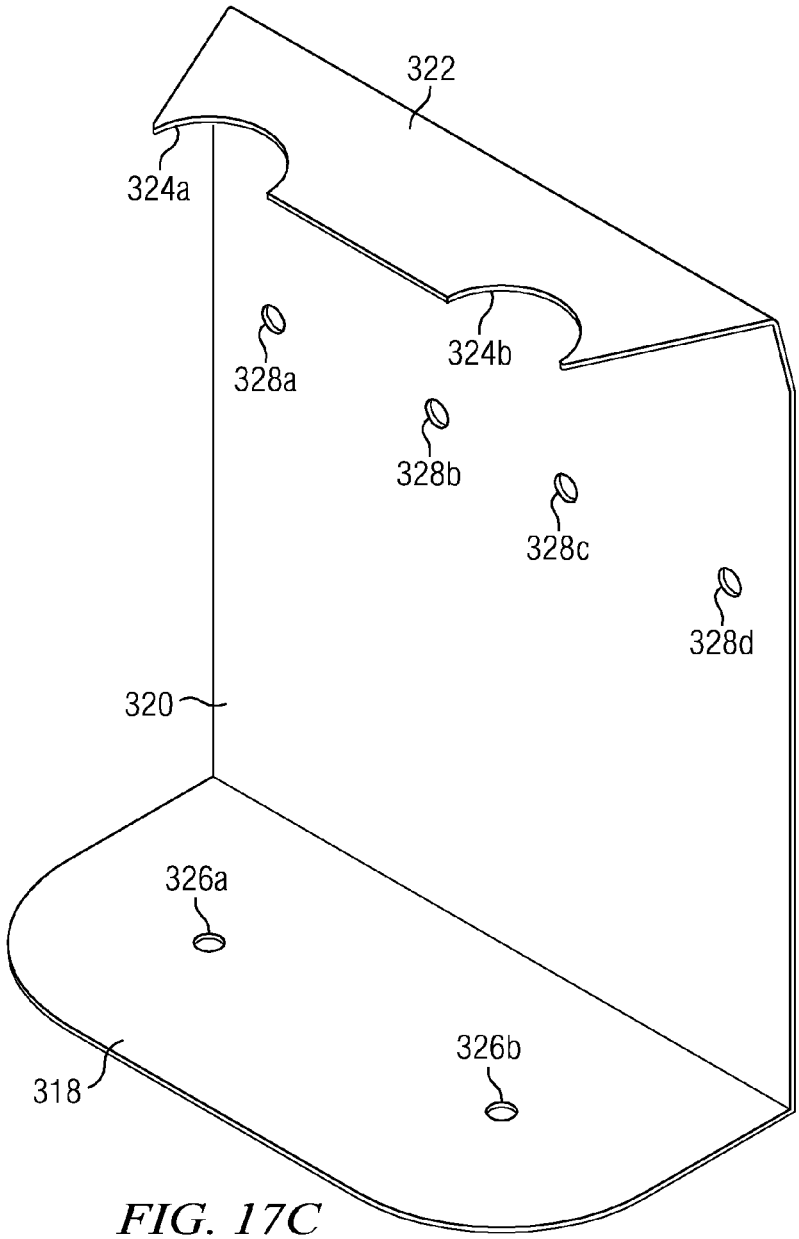
Figure 17D:
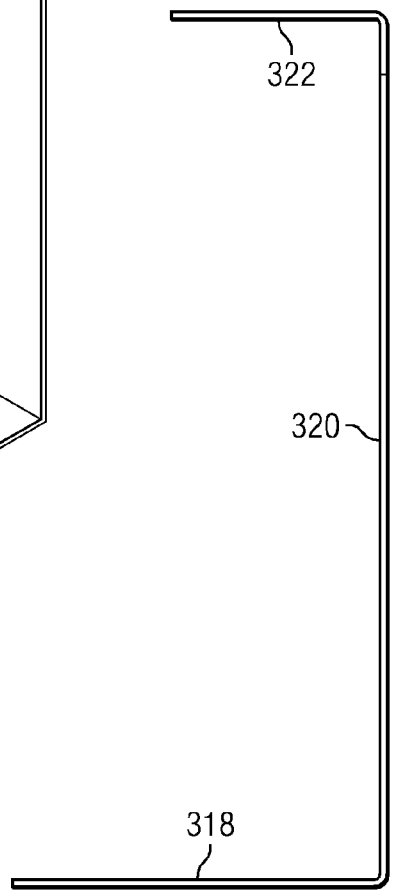

FIGS. 17A-17D illustrate an embodiment of the double bottle support 302 of FIGS. 16A-16B. FIG. 17A illustrates a top view of the embodiment of the double bottle support 302. FIG. 17B illustrates a front view of the embodiment of the double bottle support 302. FIG. 17C illustrates a perspective view of the embodiment of the double bottle support 302. FIG. 17D illustrates a side view of the embodiment of the double bottle support 302. The double bottle support 302 includes a base portion 318, a body portion 320, and a top portion 322. In the particular embodiment of the double bottle support 302 illustrated in FIGS. 16A-16B, the base portion 318 and top portion 322 lie in planes substantially parallel to each other, and the base portion 318 and top portion 322 lie in planes perpendicular to that of the body portion 320. The top portion 312 has first and second inward arcuate-shaped edges 324*a*, 324*b* along a portion to accommodate a top and/or dispenser portion of two containers. In a particular embodiment, the first and second arcuate-shaped edges 324*a*, 324*b* are each formed in a substantially half-circular shape. The base portion 318 includes a body mounting hole 326*a*, 326*b* which may be used to mount the double bottle support 302 to a horizontal surface. The body portion 320 includes one or more body mounting holes 328*a*, 328*b*, 328*c*, 328*d*, which may be used to mount the double bottle support 302 to a vertical surface.

Figure 18A:
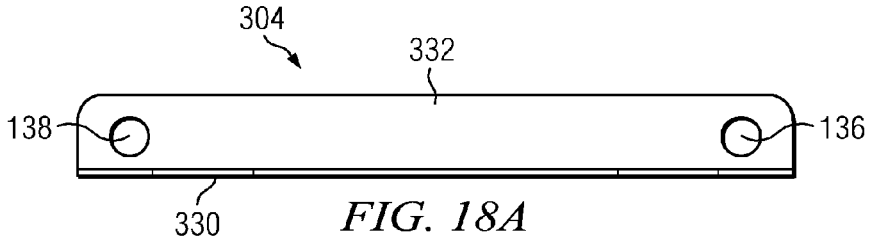
FIGS. 18A-18D illustrate an embodiment of the double collar plate of the double locking bottle holder of the double bottle support of FIGS. 16A-16B.
Figure 18B:
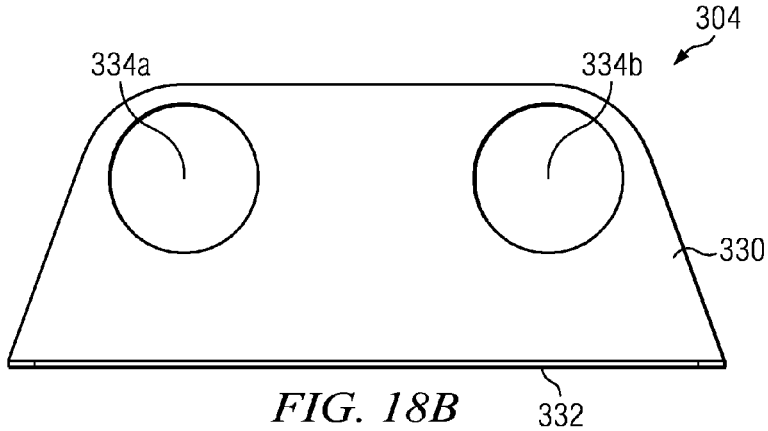
Figure 18C:
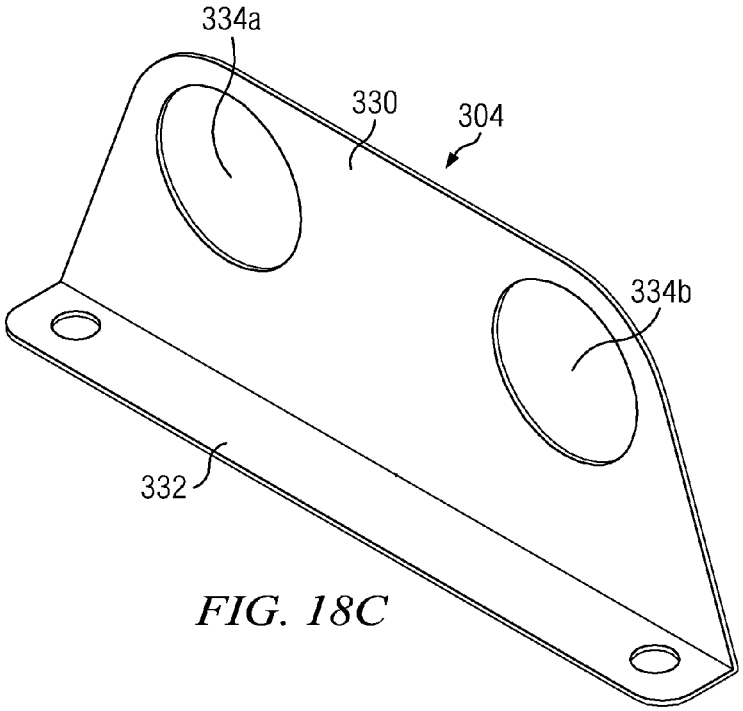
Figure 18D:
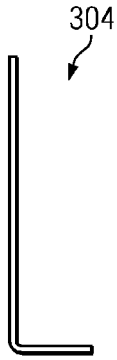

FIGS. 18A-18D illustrate an embodiment of the double collar plate 304 of the double locking bottle holder 300 of FIGS. 16A-16B. FIG. 18A illustrates a front view of the embodiment of the double collar plate 304. FIG. 18B illustrates a bottom view of the embodiment of the double collar plate 304. FIG. 18C illustrates a perspective view of the embodiment of the double collar plate 304. FIG. 18D illustrates a side view of the embodiment of the double collar plate 304. The double collar plate 304 includes a collar portion 330 and a support portion 332. The collar portion 330 includes dispenser openings 334*a*, 334*b* therethrough to allow a portion of a first and second container to pass through the dispenser opening 334*a*, 334*b*, respectively. The support portion 332 includes a first limit pin hole 136 and a second limit pin hole 138. In at least one embodiment, the collar portion 330 and the support portion 332 lie in planes substantially perpendicular to each other.

Figure 19A:
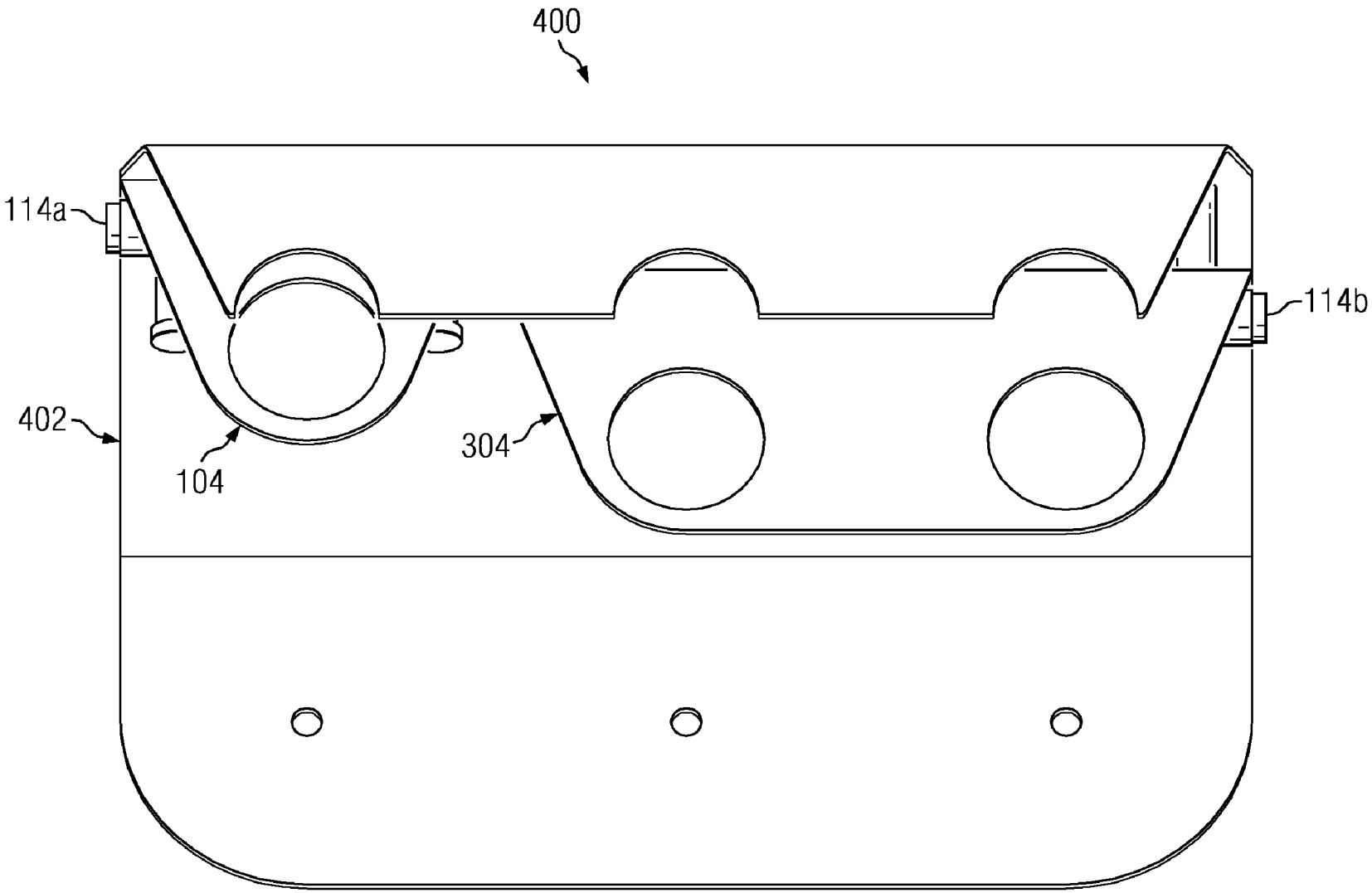
FIGS. 19A-19B illustrate an embodiment of a triple locking bottle holder configured to securely mount and hold up to three dispensing containers.
Figure 19B:
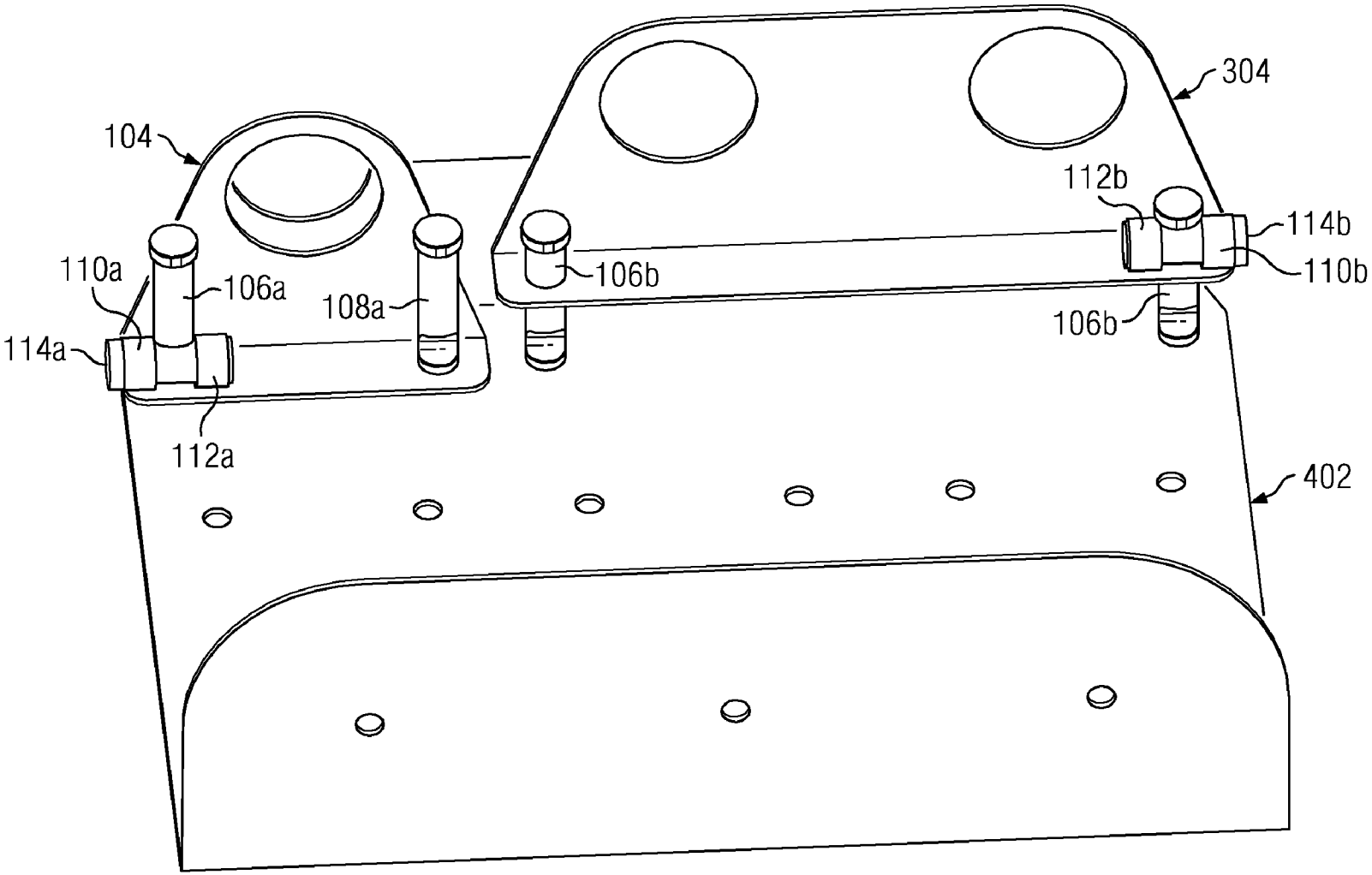

FIGS. 19A-19B illustrate an embodiment of a triple locking bottle holder 400 configured to securely mount and hold up to three dispensing containers. The triple locking bottle holder 400 includes a triple bottle support 402, a single collar plate 104, a double collar plate 304, a first limit pin 106*a*, a second limit pin 108*a*, a third limit pin 106*b*, a fourth limit pin 108*b*, a first ring 110*a*, a second ring 112*a*, a third ring 110*b*, a fourth ring 112*b*, a first floating lock pin 114*a*, a second floating lock pin 114*b*, a first snap ring 116*a*, and a second snap ring 116*b*. FIG. 19A illustrates a top perspective view of the embodiment of the triple locking bottle holder 400. FIG. 19B illustrates a bottom perspective view of the embodiment of the triple locking bottle holder 400. The single collar plate 104 is supported by the first limit pin 106*a* and the second limit pin 108*a*, and the double collar plate 304 is supported by the third limit pin 106*b* and the fourth limit pin 108*b*. The first ring 110*a* and second ring 112*a* are attached to the single collar plate 104 to support the first floating lock pin 114*a*. The third ring 110*b* and the fourth ring 112*b* are attached to the double collar plate 304 to support the second floating lock pin 114*b*. The triple locking bottle holder 400 is configured such that the single collar plate 104 and the double collar plate 304 each may be independently placed in a locked or unlocked position. The single collar plate 104 may be used to secure and hold a single dispensing container, and the double collar plate 304 may be used to secure and hold up to two dispensing containers. In the embodiment illustrated in FIGS. 19A-19B, the single collar plate 104 is in the locked position and the double collar plate 304 is in the unlocked position.

Figure 20A:
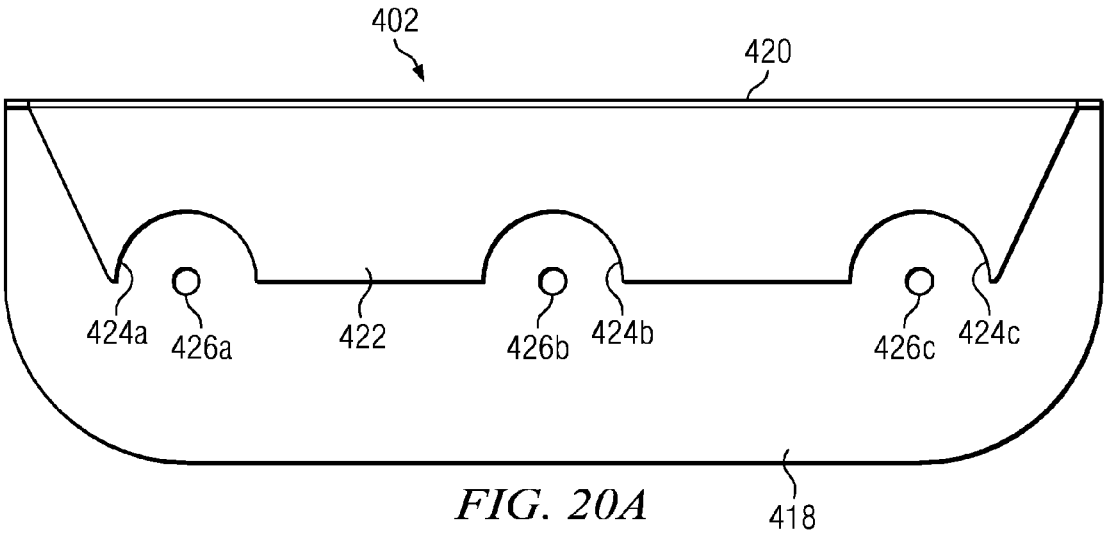
FIGS. 20A-20D illustrate an embodiment of the triple bottle support of FIGS. 19A-19B.
Figure 20B:
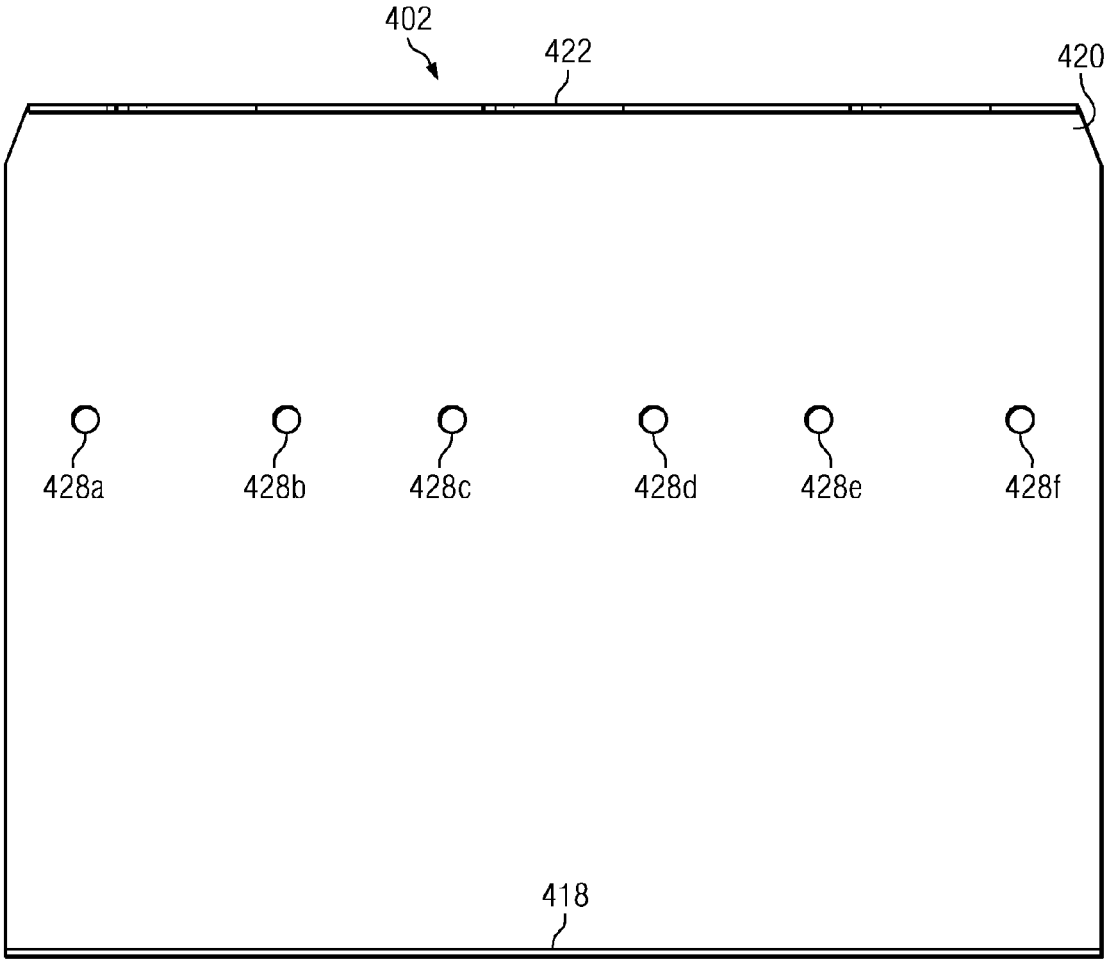
Figure 20C:
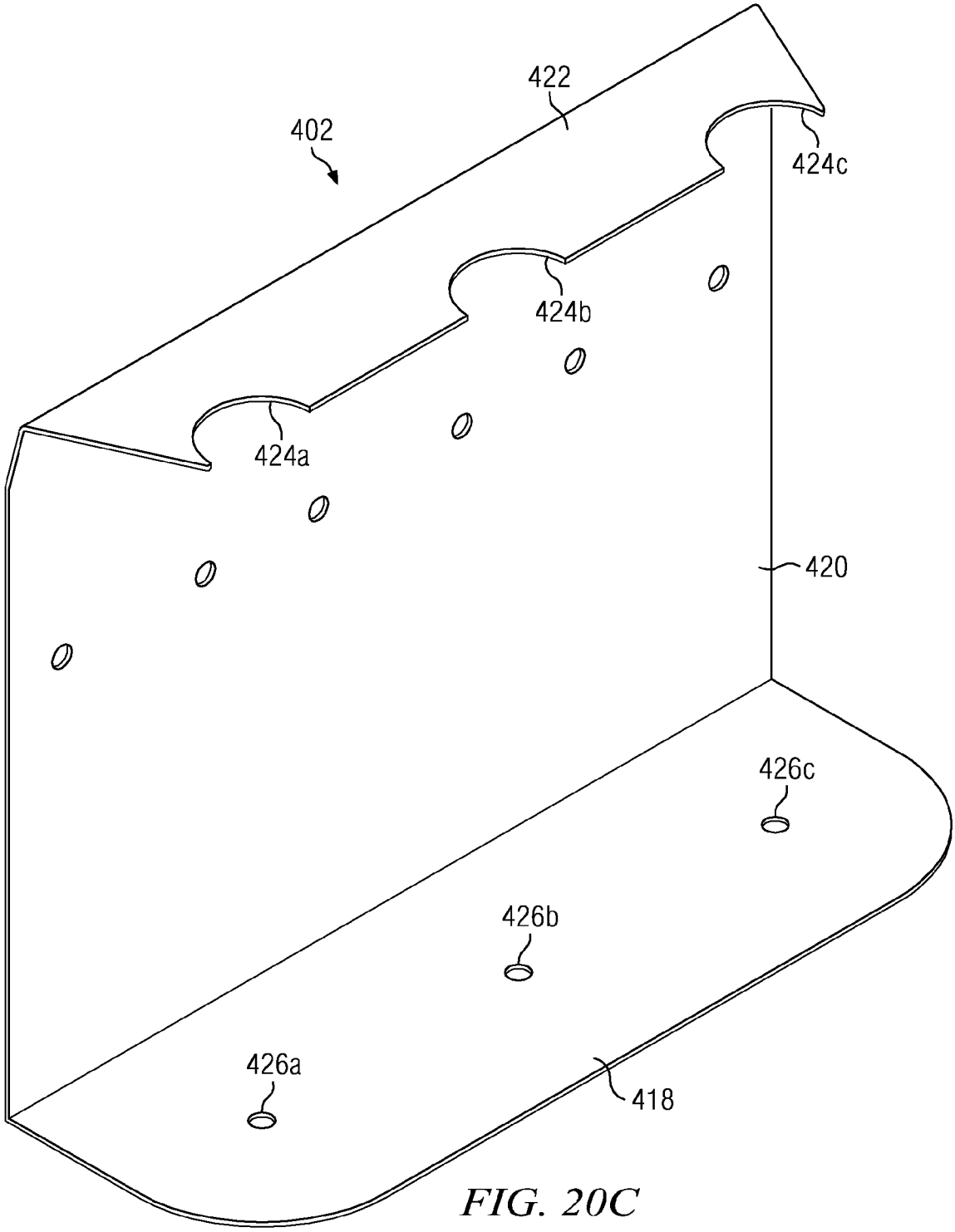
Figure 20D:
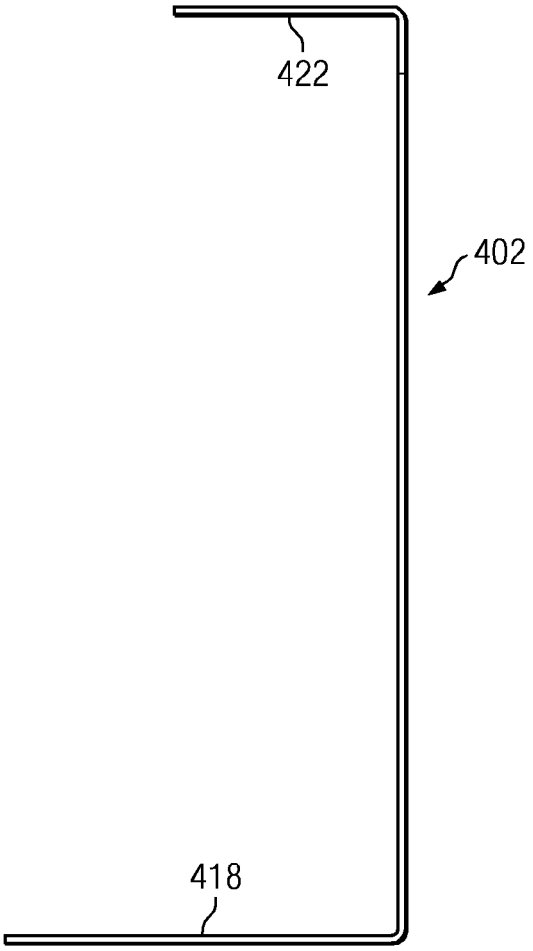

FIGS. 20A-20D illustrate an embodiment of the triple bottle support 402 of FIGS. 19A-19B. FIG. 20A illustrates a top view of the embodiment of the triple bottle support 402. FIG. 20B illustrates a front view of the embodiment of the triple bottle support 402. FIG. 20C illustrates a perspective view of the embodiment of the triple bottle support 402. FIG. 20D illustrates a side view of the embodiment of the triple bottle support 402. The triple bottle support 402 includes a base portion 418, a body portion 420, and a top portion 422. In the particular embodiment of the triple bottle support 402 illustrated in FIGS. 19A-19C, the base portion 418 and top portion 422 lie in planes substantially parallel to each other, and the base portion 418 and top portion 422 lie in planes perpendicular to that of the body portion 420. The top portion 422 has first, second and third arcuate-shaped edges 424*a*, 424*b*, 424*c* along a portion to accommodate a top and/or dispenser portion of up to three dispensing containers. In a particular embodiment, the first, second, and third arcuate-shaped edges 424*a*, 424*b*, 424*c* are each formed in a substantially half-circular shape. The base portion 418 includes body mounting holes 426*a*, 426*b*, 426*c*, which may be used to mount the triple bottle support 402 to a horizontal surface. The body portion 420 includes one or more body mounting holes 428*a*-428*f*, which may be used to mount the triple bottle support 402 to a vertical surface.

Figure 21A:
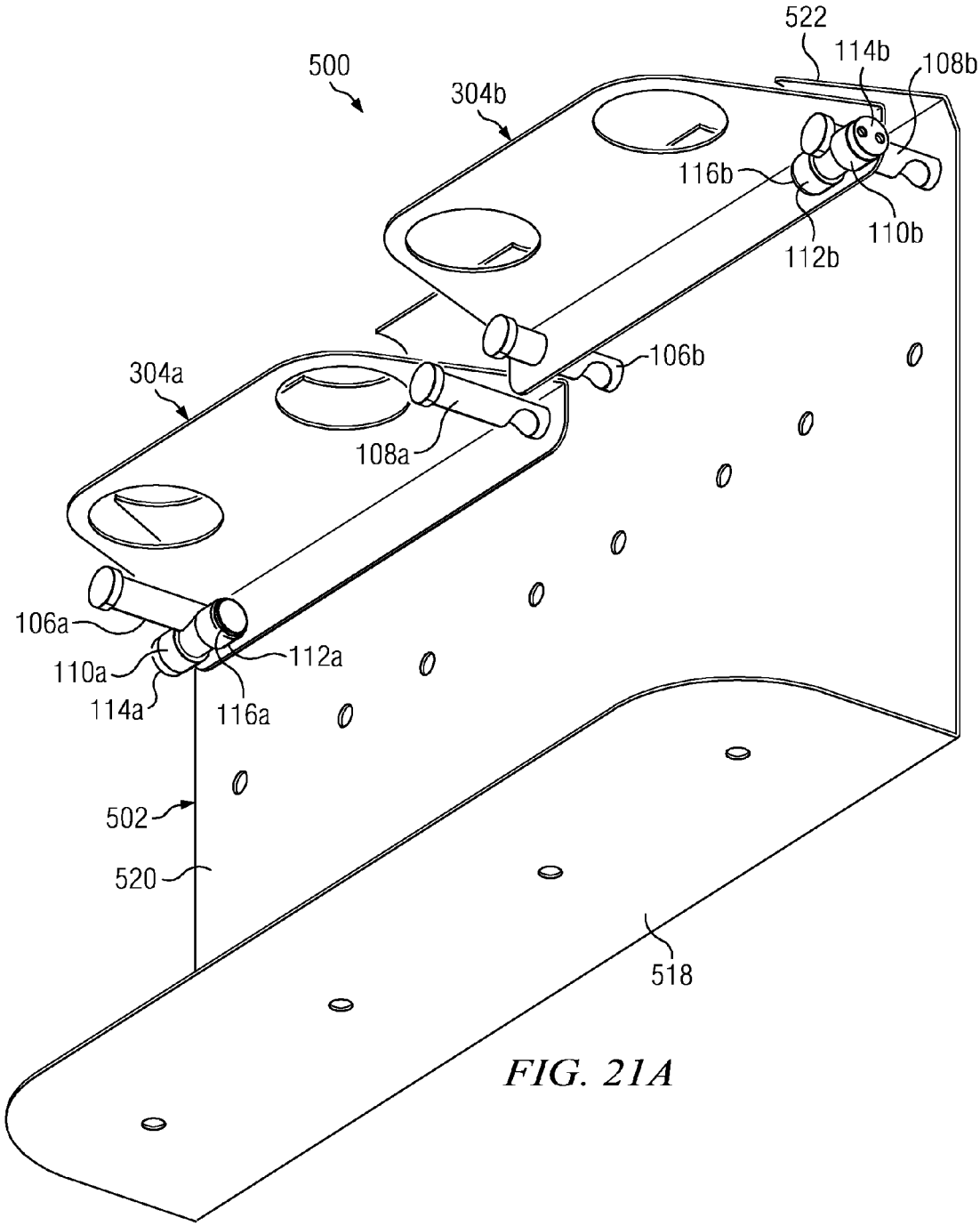
FIGS. 21A-21D illustrate an embodiment of a quadruple locking bottle holder configured to securely mount and hold up to four dispensing containers.
Figure 21B:
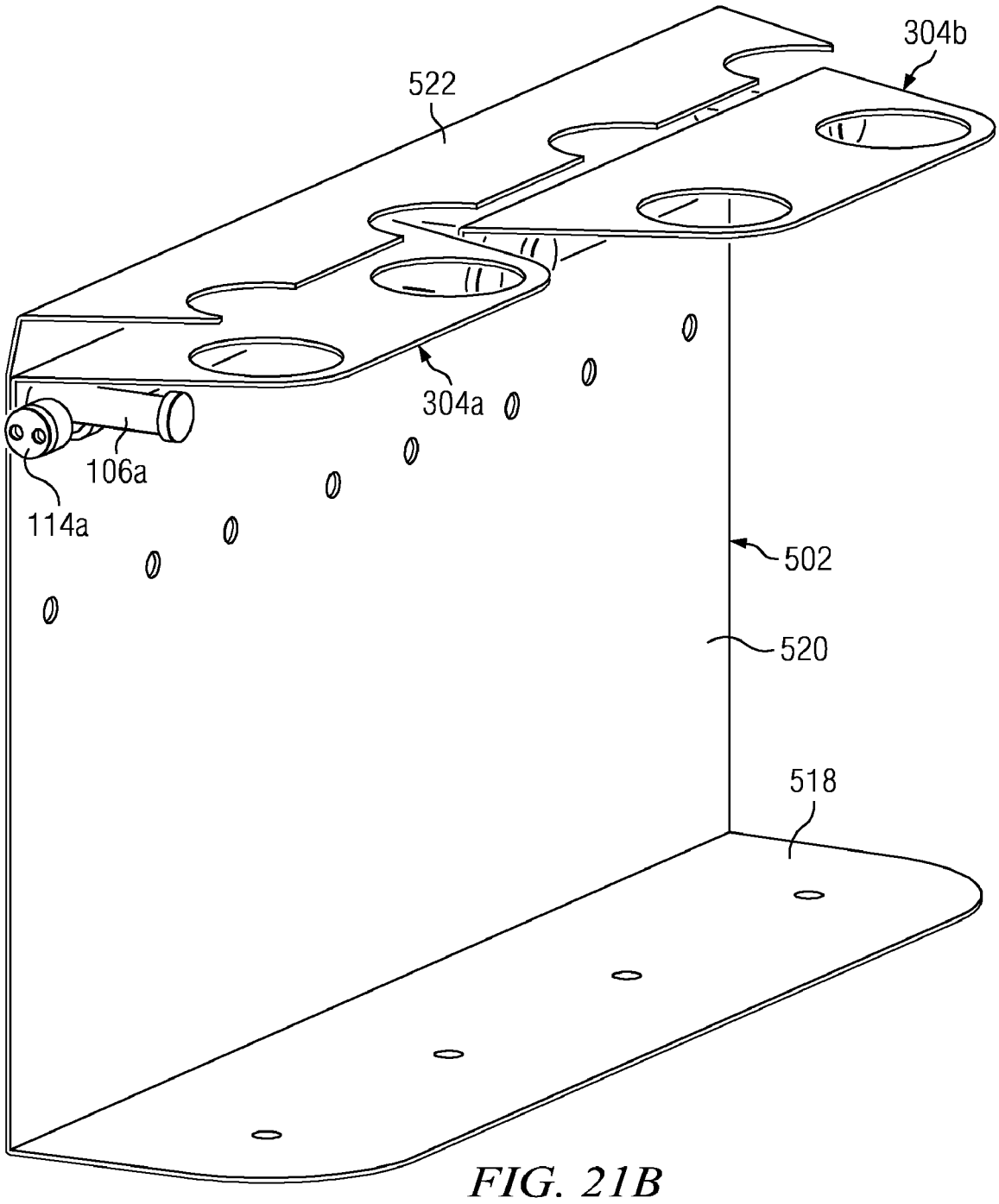
Figure 21C:
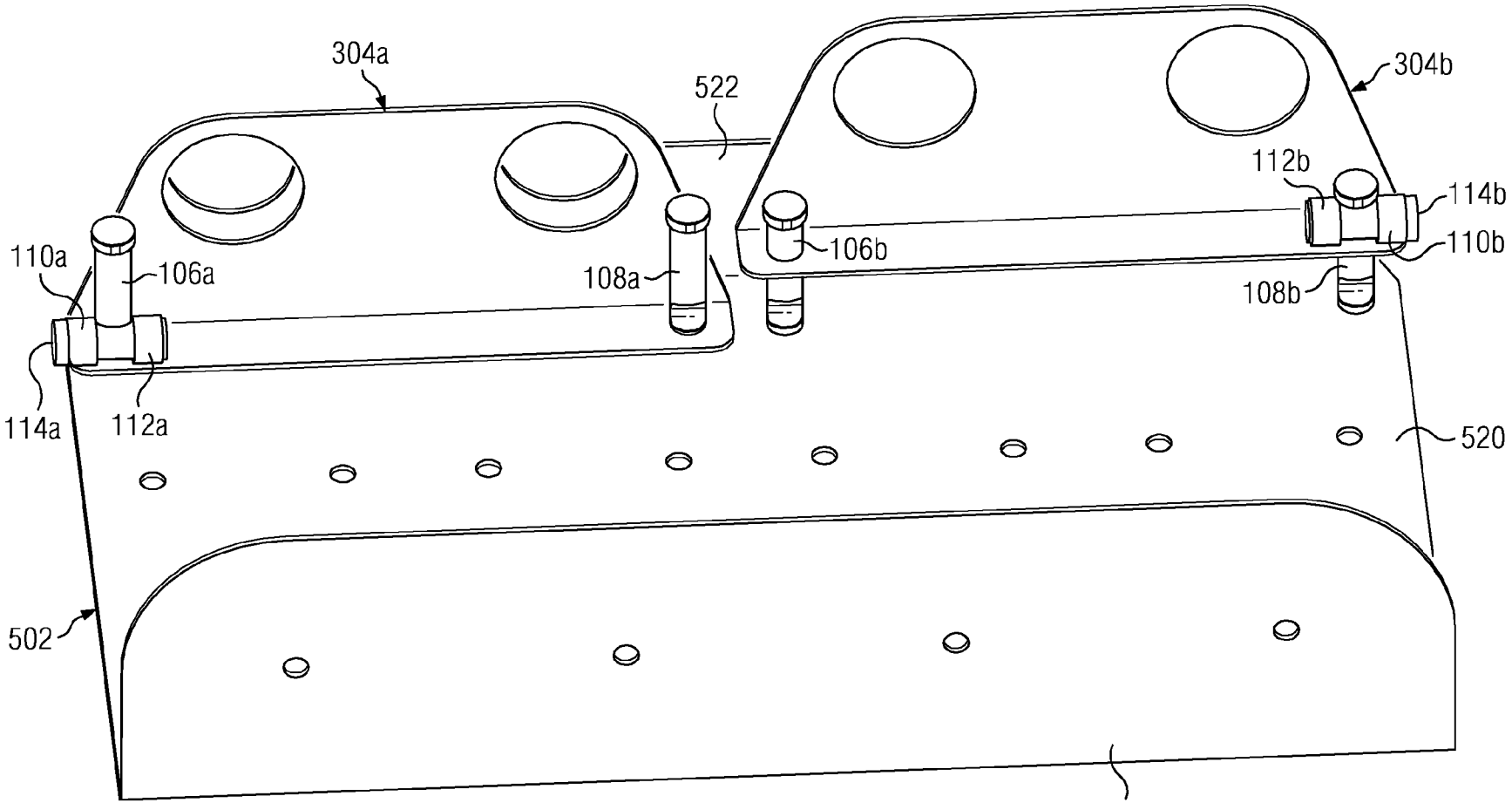
Figure 21D:
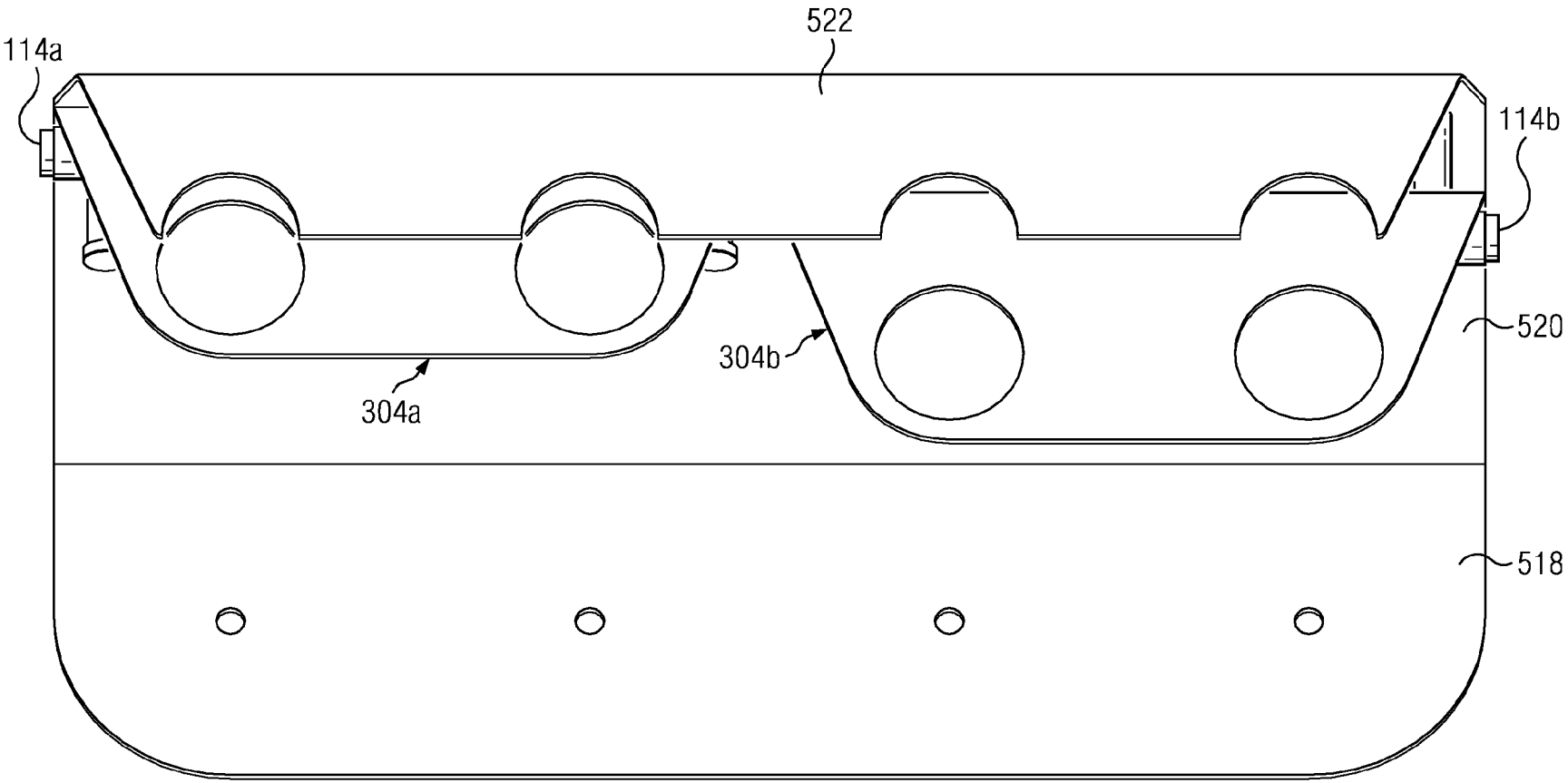

FIGS. 21A-21D illustrate an embodiment of a quadruple locking bottle holder 500 configured to securely mount and hold up to four dispensing containers. The quadruple locking bottle holder 500 includes a quadruple bottle support 502, a first double collar plate 304*a*, a second double collar plate 304*b*, a first limit pin 106*a*, a second limit pin 108*a*, a third limit pin 106*b*, a fourth limit pin 108*b*, a first ring 110*a*, a second ring 112*a*, a third ring 110*b*, a fourth ring 112*b*, a first floating lock pin 114*a*, a second floating lock pin 114*b*, a first snap ring 116*a*, and a second snap ring 116*b*. FIG. 21A illustrates a bottom perspective view of the embodiment of the quadruple locking bottle holder 500. FIG. 21B illustrates a left side perspective view of the embodiment of the quadruple locking bottle holder 500. FIG. 21C illustrates a bottom perspective view of the embodiment of the quadruple locking bottle holder 500. FIG. 21D illustrates a top perspective view of the embodiment of the quadruple locking bottle holder 500.

The first double collar plate 304*a* is supported by the first limit pin 106*a* and the second limit pin 108*a*, and the second double collar plate 304*b* is supported by the third limit pin 106*b* and the fourth limit pin 108*b*. The first ring 110*a* and second ring 112*a* are attached to the single collar plate 104 to support the first floating lock pin 114*a*. The third ring 110*b* and the fourth ring 112*b* are attached to the double collar plate 304 to support the second floating lock pin 114*b*. The quadruple locking bottle holder 500 is configured such that the first double collar plate 304*a* and the second double collar plate 304*b* each may be independently placed in a locked or unlocked position. Each of the first double collar plate 304*a* and the second double collar plate 304*b* may be used to secure and hold up to two dispensing containers such that the quadruple locking bottle holder 500 may be used to securely hold up to four dispensing containers. In the embodiment illustrated in FIGS. 21A-21D, the first double collar plate 304*a* is in the locked position and the second double locking plate 304*b* is in the unlocked position.

Figure 22D:
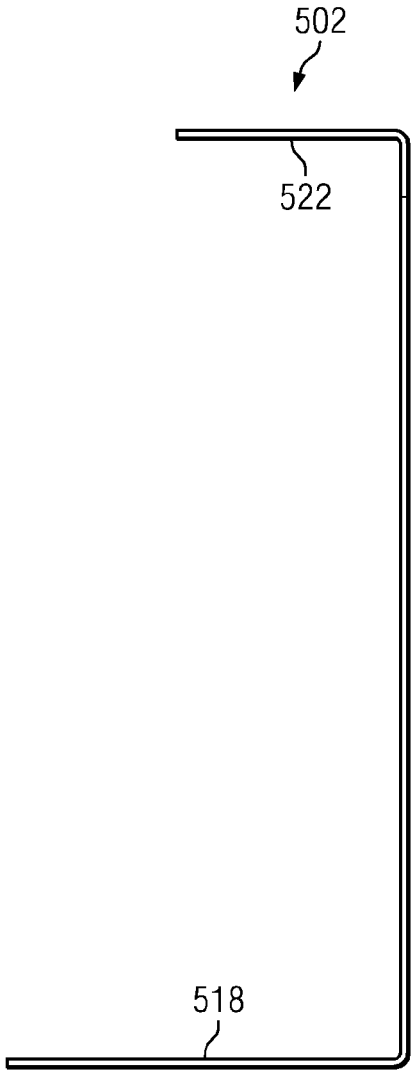
FIGS. 22A-22D illustrate an embodiment of the quadruple bottle support of FIGS. 21A-21D.
Figure 22A:
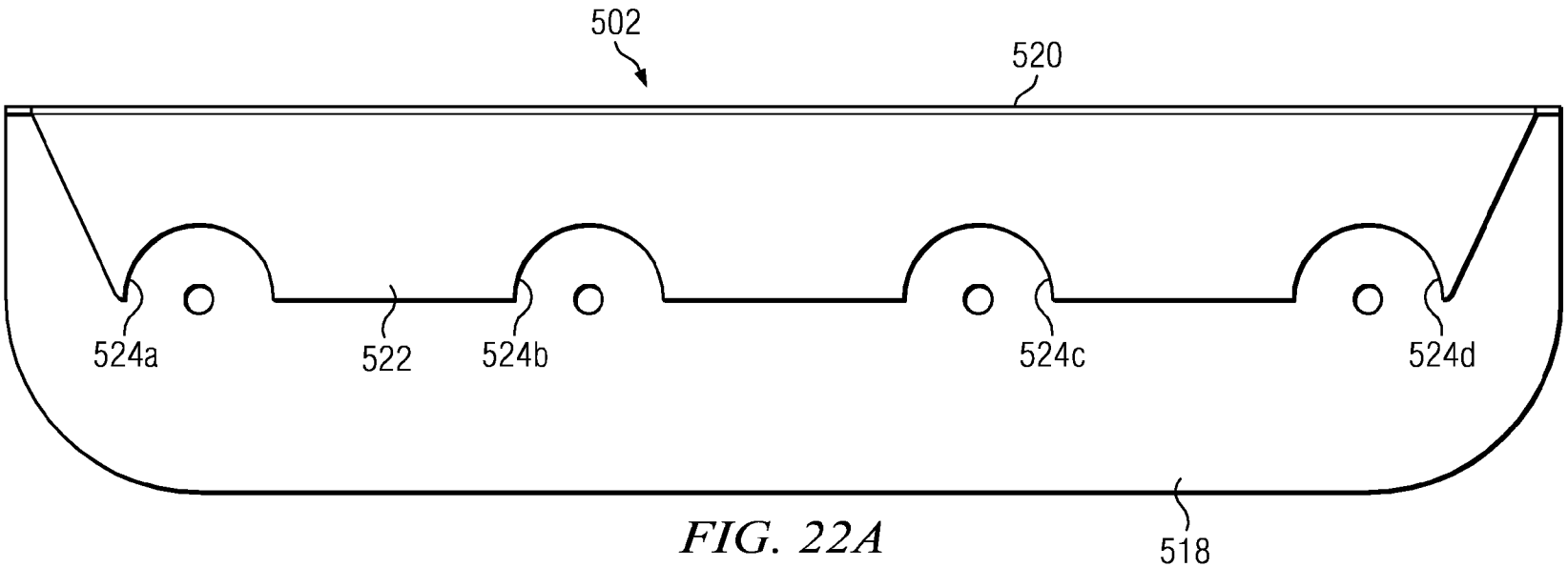
Figure 22B:
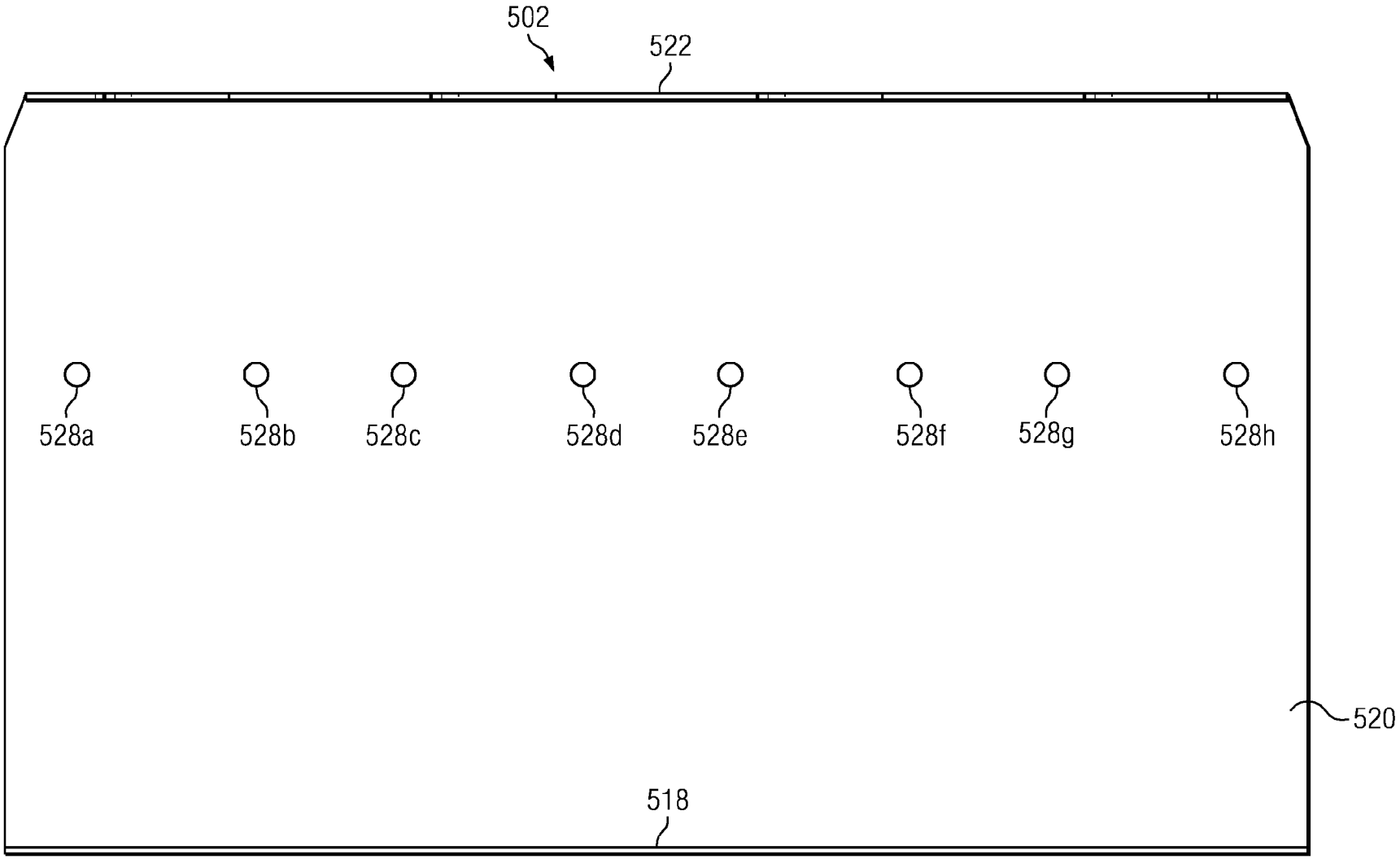
Figure 22C:
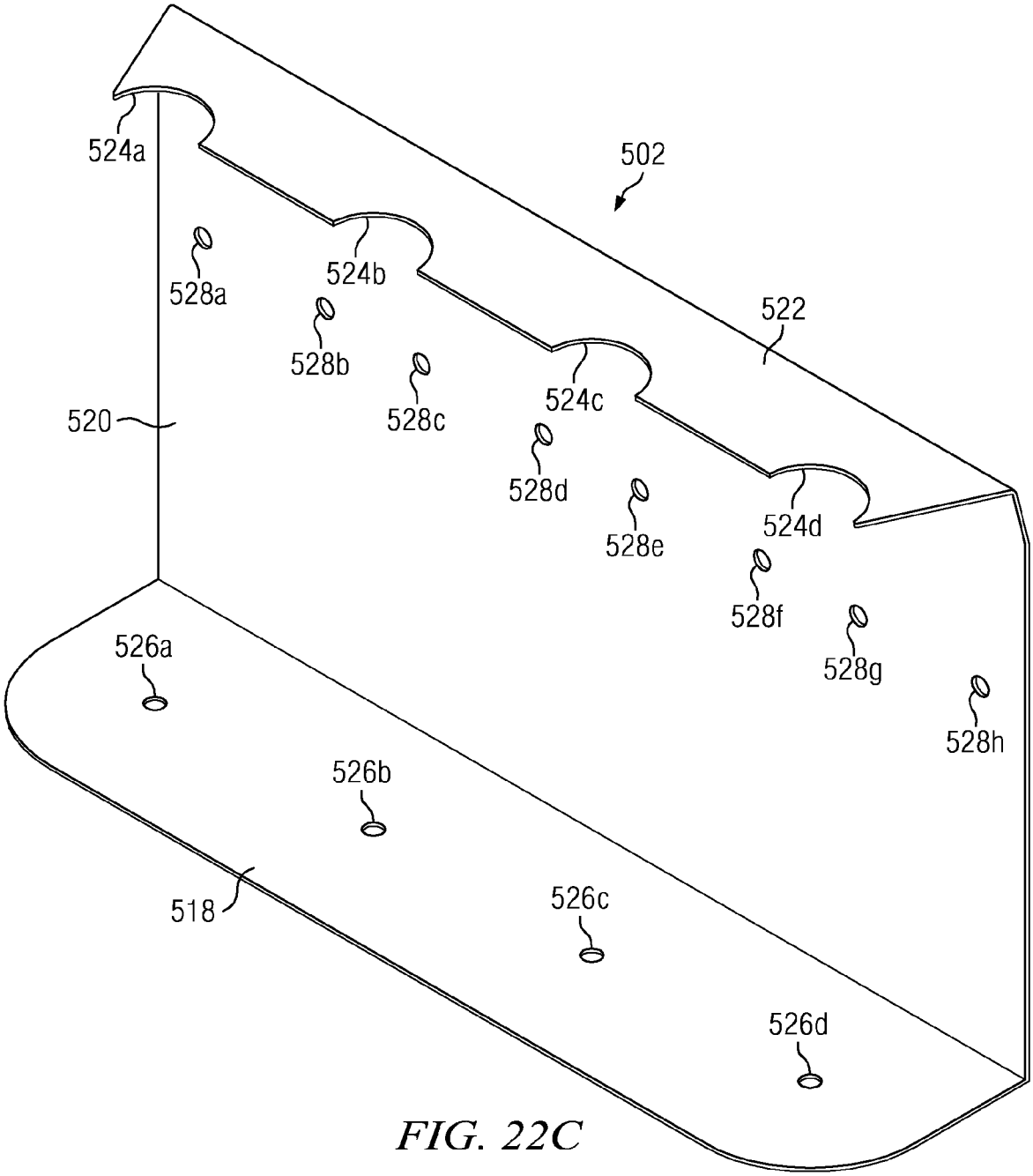

FIGS. 22A-22D illustrate an embodiment of the quadruple bottle support 502 of FIGS. 21A-21D. FIG. 22A illustrates a top view of the embodiment of the quadruple bottle support 502. FIG. 22B illustrates a front view of the embodiment of the quadruple bottle support 502. FIG. 22C illustrates a perspective view of the embodiment of the quadruple bottle support 502. FIG. 22D illustrates a side view of the embodiment of the quadruple bottle support 502. The quadruple bottle support 502 includes a base portion 518, a body portion 520, and a top portion 522. In the particular embodiment of the quadruple bottle support 502 illustrated in FIGS. 21A-21D, the base portion 518 and top portion 522 lie in planes substantially parallel to each other, and the base portion 518 and top portion 522 lie in planes perpendicular to that of the body portion 520. The top portion 522 has first, second, third, and fourth arcuate-shaped edges 524*a*, 524*b*, 524*c*, 524*d* along a portion to accommodate a top and/or dispenser portion of up to four dispensing containers. In a particular embodiment, the first, second, third, and fourth arcuate-shaped edges 524*a*, 524*b*, 524*c*, 524*d* are each formed in a substantially half-circular shape. The base portion 518 includes body mounting holes 526*a*, 526*b*, 526*c*, 526*d*, which may be used to mount the quadruple bottle support 502 to a horizontal surface. The body portion 520 includes one or more body mounting holes 528*a*-528*h*, which may be used to mount the quadruple bottle support 502 to a vertical surface.

It will be appreciated by those skilled in the art having the benefit of this disclosure that embodiments of this bracket with locking mechanism for fluid dispenser provides for securely mounting and holding one or more dispensing containers. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A locking bottle holder comprising:

a bottle support including:

a base portion;

a body portion; and a top portion;

a collar plate including:

a collar portion having at least one dispenser opening therethrough; and a support portion having a first limit pin hole;

a first limit pin including a first limit pin shaft having a first end affixed to the body portion of the bottle support and a first limit pin notch proximate to the first end, the first limit pin shaft passing through the first limit pin hole of the support portion of the collar plate to facilitate sliding of the first limit pin hole of the collar plate along a portion of the first limit pin shaft of the first limit pin;

a first ring affixed to the support portion of the collar plate and proximate to a first side of the first limit pin hole of the collar plate;

a floating lock pin passing through the first ring, the floating lock pin including a lock pin shaft having a lock pin notch, the floating lock pin being rotatable between an unlocked position and a locked position; and wherein in the locked position the support portion of the collar plate is positioned proximate to the body portion of the bottle support and the lock pin shaft of the floating lock pin is substantially engaged with the limit pin notch of the first limit pin.

2. The locking bottle holder of claim 1, wherein the top portion includes at least one arcuate-shaped edge along a portion thereof.

3. The locking bottle holder of claim 1, wherein the unlocked position the support portion of the collar plate is positioned away from the body portion of the bottle support and the lock pin notch of the floating lock pin is substantially engaged with the first limit pin shaft of the first limit pin.

4. The locking bottle holder of claim 1, further comprising:

a second ring affixed to the support portion of the collar plate and proximate to a second side of the first limit pin hole of the collar plate.

5. The locking bottle holder of claim 1, wherein the first limit pin further includes a first limit pin head at a second end of the first limit pin shaft, the first limit pin head having a cross-sectional diameter greater than a cross-sectional diameter of the first limit pin hole.

6. The locking bottle holder of claim 1, further comprising:

a second limit pin including a second limit pin shaft having a first end affixed to the body portion of the bottle support, the support portion of the collar plate further including a second limit pin hole and the second limit pin shaft passing through the second limit pin hole of the collar plate to facilitate sliding of the second limit pin hole of the collar plate along a portion of the second limit pin shaft of the second limit pin.

7. The locking bottle holder of claim 6, wherein the second limit pin further includes a second limit pin head at a second end of the second limit pin shaft, the second limit pin head having a cross-sectional diameter greater than a cross-sectional diameter of the second limit pin hole.

8. The locking bottle holder of claim 1, wherein the dispenser opening of the collar plate is configured to receive a top portion of a dispenser container therethrough and the base portion of the bottle support is configured to rest a body portion of the dispensing container thereon.

9. The locking bottle holder of claim 8, wherein the top portion of the bottle support is disposed adjacent to one or more of the top portion of the dispenser container and a dispenser portion of the dispensing container.

10. The locking bottle holder of claim 1, wherein the lock pin notch is configured to substantially engage a portion of a circumference of the first limit pin shaft.

11. The locking bottle holder of claim 1, wherein the first limit pin notch is configured to substantially engage a portion of a circumference of the lock pin shaft.

12. The locking bottle holder of claim 1, wherein the floating lock pin includes a lock pin head at a first end of the lock pin shaft, the lock pin head having a cross-sectional diameter greater than a cross-sectional diameter of the lock pin shaft.

13. The locking bottle holder of claim 1, wherein the lock pin further includes a snap ring groove at a second end of the lock pin shaft.

14. The locking bottle holder of claim 11, further comprising a snap ring configured to secure the floating lock pin within the first ring.

15. The locking bottle holder of claim 1, wherein the floating lock pin further includes at least one keyhole disposed within a top surface of the lock pin head.

16. The locking bottle holder of claim 1, wherein the base portion of the bottle support includes at least one base mounting hole.

17. The locking bottle holder of claim 1, wherein the body portion of the bottle support includes at least one body mounting hole.

18. A locking bottle holder comprising:

a bottle support including:

a base portion;

a body portion; and a top portion, the top portion having an arcuate-shaped edge along a portion thereof;

a collar plate including:

a collar portion having a dispenser opening therethrough; and a support portion having a first limit pin hole and a second limit pin hole therethrough;

a first limit pin including a first limit pin shaft having a first end affixed to the body portion of the bottle support and a first limit pin notch proximate to the first end, the first limit pin shaft passing through the first limit pin hole of the support portion of the collar plate to facilitate sliding of the first limit pin hole of the collar plate along a portion of the first limit pin shaft of the first limit pin;

a second limit pin including a second limit pin shaft having a first end affixed to the body portion of the bottle support, the second limit pin shaft passing through the second limit pin hole of the collar plate to facilitate sliding of the second limit pin hole of the collar plate along a portion of the second limit pin shaft of the second limit pin;

a first ring affixed to the support portion of the collar plate and proximate to a first side of the first limit pin hole of the collar plate;

a second ring affixed to the support portion of the collar plate and proximate to a second side of the first limit pin hole of the collar plate;

a floating lock pin passing through the first ring and the second ring, the floating lock pin including a lock pin shaft having a lock pin notch, the floating lock pin being rotatable between an unlocked position and a locked position;

wherein in the unlocked position the support portion of the collar plate is positioned away from the body portion of the bottle support and the lock pin notch of the floating lock pin is substantially engaged with the first limit pin shaft of the first limit pin; and wherein in the locked position the support portion of the collar plate is positioned proximate to the body portion of the bottle support and the lock pin shaft of the floating lock pin is substantially engaged with the limit pin notch of the first limit pin.

* * * * *